US012751528B2

(12) United States Patent
Cho

(10) Patent No.: US 12,751,528 B2
(45) Date of Patent: Oct. 6, 2026

(54) COVER DEVICE

(71) Applicant: MOKIBO, INC., Seongnam-si (KR)

(72) Inventor: Eunhyung Cho, Yongin-si (KR)

(73) Assignee: MOKIBO, INC., Seongnam-si (KR)

( * ) Notice: Subject to any disclaimer, the term of this patent is extended or adjusted under 35 U.S.C. 154(b) by 240 days.

(21) Appl. No.: 18/779,574

(22) Filed: Jul. 22, 2024

(65) Prior Publication Data

US 2024/0374001 A1 Nov. 14, 2024

Related U.S. Application Data

(63) Continuation of application No. PCT/KR2023/021615, filed on Dec. 26, 2023.

(30) Foreign Application Priority Data

Feb. 23, 2023 (KR) ..... 10-2023-0024412

(51) Int. Cl.
*A45C 11/00* (2006.01)

(52) U.S. Cl.
CPC ..... *A45C 11/00* (2013.01); *A45C 11/003* (2025.01); *A45C 2200/15* (2013.01)

(58) Field of Classification Search
CPC ..... A45C 11/00; A45C 11/003; A45C 11/002; A45C 2200/15; A45C 13/1069; A45C 11/001; A45C 13/002; A45C 13/02; A45C 2013/025; A45C 3/06; A45C 11/04
USPC ..... 455/90.3
See application file for complete search history.

(56) References Cited

U.S. PATENT DOCUMENTS

2020/0264755 A1* 8/2020 Jin ..... G06F 3/0412
2025/0253706 A1* 8/2025 Yoshino ..... H02J 50/10

FOREIGN PATENT DOCUMENTS

| | | | |
|---|---|---|---|
| EP | 4 113 246 | A1 | 1/2023 |
| JP | 2018-526750 | A | 9/2018 |
| KR | 10-2012-0140504 | A | 12/2012 |
| KR | 20-0464932 | Y1 | 1/2013 |
| KR | 20-2014-0002784 | U | 5/2014 |
| KR | 10-2021-0121721 | A | 10/2021 |
| WO | 2017/040093 | A1 | 3/2017 |

OTHER PUBLICATIONS

International Search Report dated Mar. 22, 2024 as received in application No. PCT/KR2023/021615.
Written Opinion dated Mar. 22, 2024 as received in application No. PCT/KR2023/021615.

* cited by examiner

*Primary Examiner* — Ajibola A Akinyemi
(74) *Attorney, Agent, or Firm* — Maschoff Brennan

(57) ABSTRACT

Proposed is a cover device including a first body including a hole in which a camera module of a target electronic device is positioned and including a magnetic material, and a second body including a first plate, a second plate, a third plate and provided in a size corresponding to the first body, wherein the second plate is rotatably connected to the first plate and the third plate is rotatably connected to the second plate, and an auxiliary plate rotatably connected to the second body.

11 Claims, 12 Drawing Sheets

COVER DEVICE

TECHNICAL FIELD

The present disclosure relates to a cover device and, more particularly, to a cover device for protecting or mounting a target tablet PC device.

BACKGROUND ART

Recently, a variety of tablet devices are being released, and a variety of cover devices are being released to protect tablet devices.

However, with existing cover devices, there are many cases in which it is difficult to mount a tablet device at an angle desired by a user or it is difficult to mount a tablet device at various angles. Even if a tablet device can be mounted at various angles, the stability of the mounted tablet device is low, so users may often feel uncomfortable when using the tablet device.

In addition, there are many cases in which existing cover devices have complex structures to mount tablet devices at various angles, and in these cases, it is not easy for a user to use a tablet device while conveniently and variously varying a mounting angle of the tablet device.

Therefore, there is a need to develop a cover device which can be stably mounted while a user can conveniently vary a mounting angle of a tablet device.

DISCLOSURE

Technical Problem

The problem to be solved by the present application is to provide a cover device capable of mounting a target electronic device at various angles.

The technical problems to be solved by the present disclosure are not limited to the above-mentioned problems, and other problems which are not mentioned will be clearly understood by those skilled in the art from the present specification and the accompanying drawings.

Technical Solution

According to an embodiment of the present application, a cover device comprising: a first body comprising a magnetic material; a second body comprising a first plate, a second plate and a third plate, wherein the second body is provided in a size corresponding to the first body, wherein the second plate is rotatably connected to the first plate, wherein the third plate is rotatably connected to the second plate; and an auxiliary plate rotatably connected to the second body; wherein the first plate is located adjacent to the first body and the third plate is located adjacent to the auxiliary plate, wherein the third plate comprises a first magnetic material such that a first support state is maintained, wherein in the first support state, at least a portion of the first plate constitutes at least a portion of a first surface of a first triangular pillar shape, at least a portion of the second plate constitutes at least a portion of a second surface of the first triangular pillar shape and at least a portion of the first body constitutes at least a portion of a third surface of the first triangular pillar shape, wherein the auxiliary plate comprises a second magnetic material such that a second support state is maintained, wherein in the second support state, at least a portion of the first plate and the second plate constitutes at least a portion of a fourth surface of a second triangular pillar shape, at least a portion of the third plate constitutes at least a portion of a fifth surface of the second triangular pillar shape and at least a portion of the first body constitutes at least a portion of a sixth surface of the second triangular pillar shape may be provided.

The technical solutions of the present disclosure are not limited to the above-mentioned solutions, and other solutions which are not mentioned will be clearly understood by those skilled in the art from the present specification and the accompanying drawings.

Advantageous Effects

According to the embodiments of the present disclosure, a cover device that can mount a target electronic device at various angles can be provided.

The effects of the present disclosure are not limited to the above-mentioned effects, and other effects which are not mentioned will be clearly understood by those skilled in the art from the present specification and accompanying drawings.

BEST MODE

Figure 1:
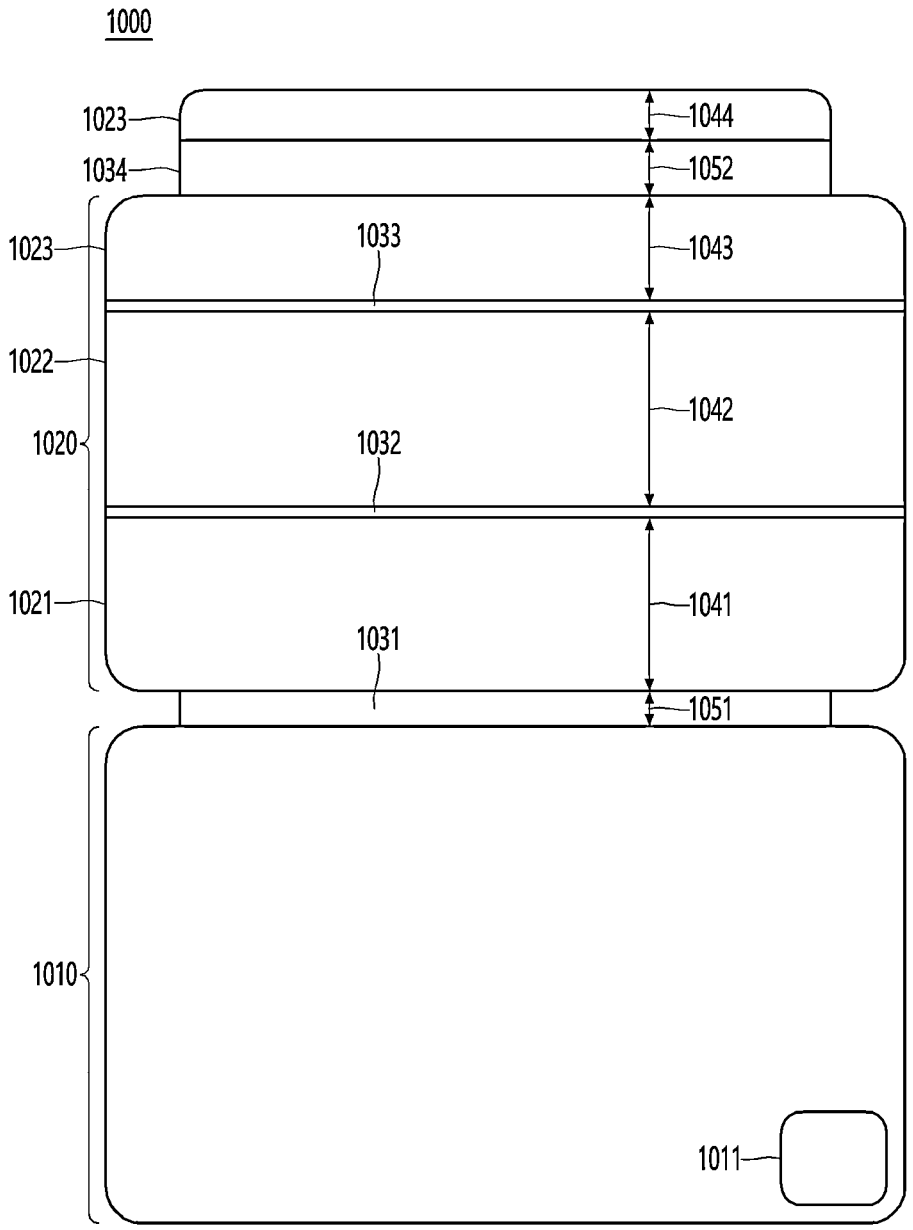
FIG. 1 is a view for illustrating a cover device according to an embodiment.

Embodiments described in the present specification are for clearly describing the idea of the present disclosure to those skilled in the art to which the present disclosure belongs, so the present disclosure is not limited to the embodiments described in the present specification and the scope of the present disclosure should be construed as including modifications or variations that are within the idea of the present disclosure.

As the terms used in the present specification, general terms currently widely used are used considering functions in the present disclosure. However, the terms may vary according to the intentions of those skilled in the art, precedents, or the emergence of new technology. However, unlike this, when a particular term is used defined as having an optional meaning, the meaning of the term will be described. Thus, the terms used in the present specification should be construed based on the actual meanings of the terms and details throughout the present specification rather than simply the names of the terms.

The drawings accompanying the present specification are for easily describing the present disclosure, and the shapes shown in the drawings may be exaggerated to help the understanding of the present disclosure, so the present disclosure is not limited by the drawings.

As used herein, when an element or layer which is referred to as being "on" another element or layer, it should be understood that an element or layer is directly on another element or layer, but also includes another element or layer interposed therebetween.

The same reference numerals used throughout the present specification may designate the same or similar elements.

The numbers (e.g., first, second, etc.) used in the description of the present specification may be construed as identification symbols to distinguish one element from another element.

The suffixes "module" and "part" for elements used in the description of the present specification are used or used interchangeably depending on the ease of making the specification, and may not have distinct meanings or roles in themselves.

In the present specification, if it is decided that a detailed description of known configuration or function related to the present disclosure makes the subject matter of the present disclosure unclear, the detailed description is omitted.

According to an embodiment of the present application, a cover device comprising: a first body comprising a magnetic material; a second body comprising a first plate, a second plate and a third plate, wherein the second body is provided in a size corresponding to the first body, wherein the second plate is rotatably connected to the first plate, wherein the third plate is rotatably connected to the second plate; and an auxiliary plate rotatably connected to the second body; wherein the first plate is located adjacent to the first body and the third plate is located adjacent to the auxiliary plate, wherein the third plate comprises a first magnetic material such that a first support state is maintained, wherein in the first support state, at least a portion of the first plate constitutes at least a portion of a first surface of a first triangular pillar shape, at least a portion of the second plate constitutes at least a portion of a second surface of the first triangular pillar shape and at least a portion of the first body constitutes at least a portion of a third surface of the first triangular pillar shape, wherein the auxiliary plate comprises a second magnetic material such that a second support state is maintained, wherein in the second support state, at least a portion of the first plate and the second plate constitutes at least a portion of a fourth surface of a second triangular pillar shape, at least a portion of the third plate constitutes at least a portion of a fifth surface of the second triangular pillar shape and at least a portion of the first body constitutes at least a portion of a sixth surface of the second triangular pillar shape may be provided.

Herein, the first triangular pillar shape varies depending on a position of the third plate or the auxiliary plate.

Herein, in the first support state, an angle between the first body and the first plate varies depending on the position of the third plate or the auxiliary plate.

Herein, in the first support state, the angle between the first body and the first plate becomes smaller as the third plate or the auxiliary plate moves toward a first end of the first body.

Herein, the first body comprises a second end located opposite the first end, wherein the first end of the first body is located father from the first plate than the second end of the first body.

Herein, the second triangular pillar shape varies depending on a position of the auxiliary plate.

Herein, in the second support state, an angle between the first body and the first plate varies depending on the position of the auxiliary plate.

Herein, in the first support state, an angle between the first body and the first plate varies depending on a position of the third plate, wherein in the second support state, the angle between the first body and the first plate varies depending on a position of the auxiliary plate, wherein a change rate of the angle between the first body and the first plate as the position of the third plate varies in the first support state is greater than a change rate of the angle between the first body and the first plate as the position of the auxiliary plate varies in the second support state.

Herein, when a width of the first plate is a first length, a width of the second plate is a second length and a width of a first connection portion connecting the first body and the first plate is a third length, the first to third length are designed to satisfy the following relational equation, [relational equation] (the first length+the third length)*0.8≤the second length≤(the first length+the third length)*1.2.

Herein, when a width of the third plate is a first length, a width of the auxiliary plate is a second length and a width of a first connection portion connecting the third plate and the auxiliary plate is a third length, the first to third length are designed to satisfy the following relational equation, [relational equation] (the second length+the third length) *0.8≤the first length≤(the second length+the third length) *1.2.

Herein, in the first support state, an outer surface of the third plate and an outer surface of the first body contact each other, wherein an outer surface of the auxiliary plate and the outer surface of the first body contact each other.

Herein, in the first support state, an inner surface of the first plate contacts with a floor on which the cover device is placed.

Herein, in the second support state, an outer surface of the auxiliary plate and an outer surface of the first body contact each other.

Herein, in at least a portion of the second support state, an angle between the first body and the third plate is 90 degrees.

Herein, the first body further comprises a protection portion for fixing or protecting a target electronic device.

Herein, the protection portion is provided in a form which can surround the edge of the target electronic device.

Herein, the first body comprises an iron plate.

Herein, at least a portion of the first body comprises a magnetic material.

Herein, in the first support state, when a magnetic force is applied between the first magnetic material included in the third plate and a magnetic material included in a first region of the first body, an angle between the first body and the first plate is a first angle, when a magnetic force is applied between the first magnetic material included in the third plate and a magnetic material included in a second region of the first body, an angle between the first body and the first plate is a second angle, wherein the first angle is different from the second angle.

Herein, when the first region of the first body is closer to the first plate than the second region of the first body, the first angle is greater than the second angle.

Hereinafter, a cover device which can mount a target electronic device at a variety of angles according to the present disclosure will be described.

Herein, the target electronic device may be a tablet PC, etc., but is not limited thereto, and may be various electronic devices, etc. to be a target according to a shape of the cover device.

FIG. 1 is a view for illustrating a cover device according to an embodiment.

Referring to FIG. 1, a cover device 1000 according to the embodiment may include a first body 1010 and a second body 1020.

Herein, the first body 1010 according to the embodiment may be a body for positioning the target electronic device.

For example, the first body 1010 according to the embodiment may be a body attached to a rear surface of the target electronic device by a magnetic force, but is not limited thereto.

In addition, the first body 1010 according to the embodiment may include at least one hole.

For example, the first body 1010 according to the embodiment may include a first hole 1011, but is not limited thereto.

In addition, at least one hole included in the first body 1010 according to the embodiment may be a hole for passing a camera of the target electronic device.

For example, the first hole 1011 included in the first body 1010 according to the embodiment may be a hole for passing a camera of the target tablet PC, but is not limited thereto.

In addition, the first body 1010 according to the embodiment may be composed of a variety of materials.

For example, the first body 1010 according to the embodiment may be composed of a plastic plate, an iron plate, etc., but is not limited thereto, and may be composed of a variety of materials provided in a plate shape.

In addition, at least a portion of the first body 1010 according to the embodiment may include a magnetic material. Herein, the magnetic material may be represented by a magnet, etc. depending on the expression, but is not limited thereto, and may be represented by a variety of materials having a magnetic force, such as an iron plate, etc.

For example, the first body 1010 according to the embodiment may be composed of a plastic plate, an iron plate, etc. having a laminated shape, but is not limited thereto.

In addition, the first body 1010 and the second body 1020 according to the embodiment may be rotatably connected to each other.

For example, the first body 1010 according to the embodiment may be rotatably connected to the second body 1020 while being spaced apart therefrom at a certain distance, but is not limited thereto.

In addition, for example, the first body 1010 and the second body 1020 according to the embodiment may be disposed to be spaced apart from each other at a certain distance and sealed to be rotatably connected to each other, but are not limited thereto.

In addition, for example, the first body 1010 and the second body 1020 according to the embodiment may be connected to each other to be mutually rotatable through a first connection portion 1031, but are not limited thereto.

The second body 1020 according to the embodiment may be a body for covering the target electronic device.

For example, the second body 1020 according to the embodiment may be a body for covering and protecting the target electronic device when the target electronic device is positioned on the first body 1010, but is not limited thereto.

In addition, the second body 1020 according to the embodiment may include at least three plates.

For example, the second body 1020 according to the embodiment may include a first plate 1021, a second plate 1022, and a third plate 1023, but is not limited thereto.

In addition, at least three plates included in the second body 1020 according to the embodiment may be composed of a variety of materials.

For example, each of the first plate 1021, the second plate 1022, and the third plate 1023 according to the embodiment may be composed of a plastic plate, an iron plate, etc., but is not limited thereto, and may be composed of a variety of materials that may be provided in a plate shape.

In addition, at least a portion of each of at least three plates included in the second body 1020 according to the embodiment may include a magnetic material. Herein, the magnetic material may be represented by a magnet, etc. depending on the expression, but is not limited thereto, and may be represented by a variety of materials having a magnetic force, such as an iron plate, etc.

For example, each of the first plate 1021, the second plate 1022, and the third plate 1023 according to the embodiment may be composed of a plastic plate and may include at least one magnetic material in at least one region, but is not limited thereto.

In addition, magnetic materials included in at least three plates included in the second body 1020 according to the embodiment may be included at different positions.

For example, a position of the magnetic material included in the first plate 1021 may be different from a position of the magnetic material included in the second plate 1022, the position of the magnetic material included in the second plate 1022 may be different from a position of the magnetic material included in the third plate 1023, and the position of the magnetic material included in the first plate 1021 may be different from the position of the magnetic material included in the third plate 1023, but are not limited thereto.

In addition, at least three plates included in the second body 1020 according to the embodiment may be rotatably connected to each other.

For example, the second plate 1022 may be rotatably connected to the first plate 1021 while being spaced apart from the first plate 1021 at a certain distance, and the third plate 1023 may be rotatably connected to the second plate 1022 while being spaced apart from the second plate 1022 at a certain distance, but are not limited thereto.

In addition, for example, the first to third plates 1021, 1022, and 1023 may be sealed after being disposed to be spaced apart at certain distances and may be rotatably connected to each other, but are not limited thereto.

In addition, for example, the first plate 1021 and the second plate 1022 are connected to each other to be mutually rotatable through a second connection portion 1032, and the second plate 1022 and the third plate 1023 may be connected to each other to be mutually rotatable through a third connection portion 1033, but are not limited thereto.

In addition, at least three plates included in the second body 1020 according to the embodiment may be positioned to be successively adjacent to the first body 1010 when the first body 1010 and the second body 1020 are placed on the same level.

For example, when the first body 1010 and the second body 1020 are placed on the same level according to the embodiment, the first plate 1021, the second plate 1022, and the third plate 1023 may be positioned to be successively adjacent to the first body 1010, but are not limited thereto.

In addition, the cover device 1000 according to the embodiment may include an auxiliary plate 1024 which may be represented as being included in the second body 1020 according to the embodiment, but is not limited thereto.

In addition, the auxiliary plate 1024 according to the embodiment may include a variety of materials.

For example, the auxiliary plate 1024 according to the embodiment may be composed of a plastic plate, an iron plate, etc., but is not limited thereto, and may be composed of a variety of materials which can be provided in a plate shape.

In addition, at least a portion of the auxiliary plate 1024 according to the embodiment may include a magnetic material. Herein, the magnetic material may be represented by a magnet, etc. depending on the expression, but is not limited thereto, and may be represented by a variety of materials having a magnetic force, such as an iron plate, etc.

For example, the auxiliary plate 1024 according to the embodiment may be composed of a plastic plate and may include at least one magnetic material in at least one region, but is not limited thereto.

In addition, the auxiliary plate 1024 according to the embodiment may be rotatably connected to the second body 1020.

For example, the auxiliary plate 1024 may be rotatably connected to the third plate 1023 included in the second body 1020 while being spaced apart therefrom at a certain distance, but is not limited thereto.

In addition, for example, the auxiliary plate 1024 and the third plate 1023 included in the second body 1020 may be sealed after being disposed to be spaced apart therefrom at a certain distance and may be rotatably connected to each other, but are not limited thereto.

In addition, for example, the auxiliary plate 1024 and the third plate 1023 included in the second body 1020 may be connected to mutually rotatable through a fourth connection portion 1034, but are not limited thereto.

In addition, in the specification, in order to describe the relationship between elements of the cover device 1000 according to the embodiment, the lengths of some elements will be represented.

For example, the length of a width of the first plate 1021 according to the embodiment may be represented by the first length 1041, the length of a width of the second plate 1022 according to the embodiment may be represented by a second length 1042, the length of a width of the third plate 1023 according to the embodiment may be represented by a third length 1043, the length of a width of the auxiliary plate 1024 according to the embodiment may be represented by a fourth length 1044, the length of a width of the first connection portion 1031 according to the embodiment may be represented by a fifth length 1051, and the length of a width of the fourth connection portion 1034 according to the embodiment may be represented by a sixth length 1052, but are not limited thereto, and may be differently represented by definition for describing embodiments.

In addition, according to the embodiment, the second length 1042 which is the length of the width of the second plate 1022 may be designed to be longer than the first length 1041 which is the length of the width of the first plate 1021, but is not limited thereto.

In addition, according to the embodiment, the second length 1042 which is the length of the width of the second plate 1022 may be substantially designed to be equal to the sum of the first length 1041 which is the length of the width of the first plate 1021 and the fifth length 1051 which is the length of the width of the first connection portion 1031, but is not limited thereto.

This length design may be to make an angle between the first body 1010 and a floor surface close to 90 degrees, in a specific state of the cover device 1000 according to the embodiment, but is not limited thereto.

In addition, according to the embodiment, the sum of the second length 1042 which is the length of the width of the second plate 1022, the first length 1041 which is the length of the width of the first plate 1021, and the fifth length 1051 which is the length of the width of the first connection portion 1031 may be designed to satisfy the following [Relational Equation 1].

$$(\text{first length} + \text{fifth length}) * 0.8 \leq \text{second length} \leq (\text{first length} + \text{fifth length}) * 1.2 \quad \text{[Relational Equation 1]}$$

In addition, according to the embodiment, the third length 1043 which is the length of the width of the third plate 1023 may be designed to be shorter than the first length 1041 which is the length of the width of the first plate 1021, but is not limited thereto.

In addition, according to the embodiment, the fourth length 1044 which is the length of the width of the auxiliary plate 1024 may be designed to be shorter than the first length 1041 which is the length of the width of the first plate 1021, but is not limited thereto.

In addition, according to the embodiment, the third length 1043 which the length of the width of the third plate 1023 may be designed to be shorter than the second length 1042 which is the length of the width of the second plate 1022, but is not limited thereto.

In addition, according to the embodiment, the fourth length 1044 which is the length of the width of the auxiliary plate 1024 may be designed to be shorter than the second length 1042 which is the length of the width of the second plate 1022, but is not limited thereto.

In addition, according to the embodiment, the fourth length 1044 which is the length of the width of the auxiliary plate 1024 may be designed to be shorter than the third length 1043 which is the length of the width of the third plate 1023, but is not limited thereto.

In addition, according to the embodiment, the third length 1043 which is the length of the width of the third plate 1023 may be designed to be substantially equal to the sum of the fourth length 1044 which is the length of the width of the auxiliary plate 1024 and the sixth length 1052 which is the length of the width of the fourth connection portion 1034, but is not limited thereto.

This length design may be to make an angle between the first body 1010 and the third plate 1023 close to 90 degrees, in a specific state of the cover device 1000 according to the embodiment, but is not limited thereto.

In addition, according to the embodiment, the sum of the third length 1043 which is the length of the width of the third plate 1023, the fourth length 1044 which is the length of the width of the auxiliary plate 1024, and the sixth length 1052 which is the length of the width of the fourth connection portion 1034 may be designed to satisfy the following [Relational Equation 2].

$$(\text{fourth length} + \text{sixth length}) * 0.8 \leq \text{third length} \leq (\text{fourth length} + \text{sixth length}) * 1.2 \quad \text{[Relational Equation 2]}$$

In addition, according to the embodiment, the length of the width of the second body 1020 may be equal to the length of the width of the target electronic device.

For example, the sum of the first to third lengths 1041 to 1043 which are the lengths of the widths of the first to third plates 1021 to 1023 included in the second body 1020 and the lengths of the widths of the second connection portion 1032 and the third connection portion 1033 may be equal to the length of the width of the target electronic device.

In addition, according to the embodiment, the length of the width of the first body 1010 may correspond to the length of the width of the second body 1020.

In addition, each of the elements included in the cover device 1000 according to the embodiment may include an inner surface and an outer surface.

Herein, the inner surface and the outer surface may be defined in various methods.

For example, the inner surface of the first body 1010 according to the embodiment may be a surface on which the target electronic device is located when the cover device 1000 is used according to a designed use.

In addition, for example, the outer surface of the first body 1010 according to the embodiment may be a surface opposite the surface on which the target electronic device is located when the cover device 1000 is used according to the designed use.

In addition, for example, the inner surface of the second body 1020 according to the embodiment may be a surface that may cover the target electronic device when the cover device 1000 is used according to the designed use.

In addition, for example, the outer surface of the second body 1020 according to the embodiment may be a surface opposite the surface that may cover the target electronic device when the cover device 1000 is used according to the designed use.

In addition, for example, the inner surface of the auxiliary plate 1024 according to the embodiment may be a surface extending from the inner surface of the second body 1020.

In addition, for example, the outer surface of the auxiliary plate 1024 according to the embodiment may be a surface extending from the outer surface of the second body 1020.

In addition, for example, when the cover device 1000 is used according to the designed use, the inner surfaces may be surfaces which may be disposed to face each other with the target electronic device located between the surfaces, and the outer surfaces may be surfaces disposed to face each other without the target electronic device located between the surfaces.

In addition, in addition to the examples described above, definitions by which the inner surface and the outer surface may be commonly understood may be included, and while the cover device 1000 is used according to the designed use and the first body 1010 and the second body 1020 cover the target electronic device to protect the target electronic device, the inner surface may be a surface facing the target electronic device, and the opposite surface may be the outer surface.

Figure 2:
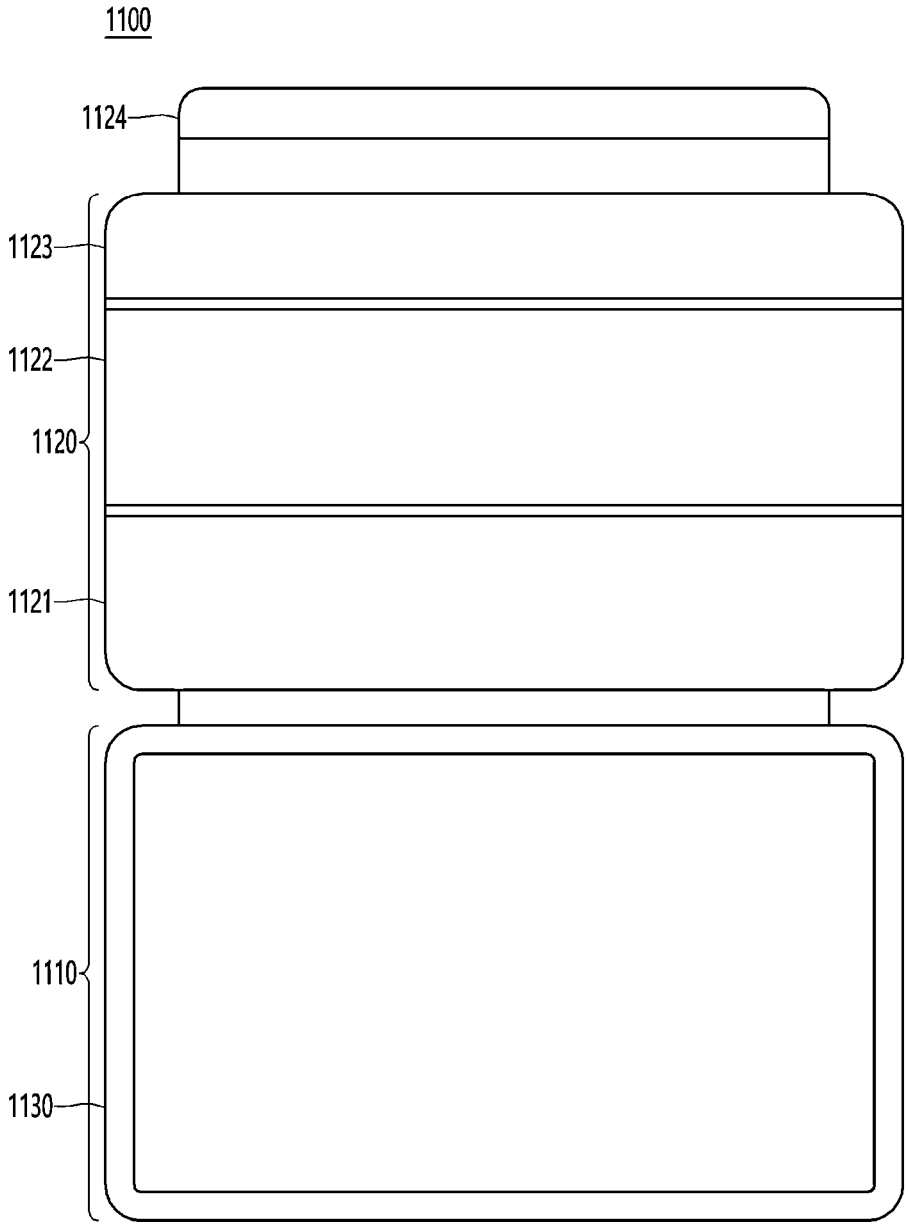
FIG. 2 is a view for illustrating a first state of use of the cover device according to the embodiment.

FIG. 2 is a view for illustrating a first state of use of the cover device according to the embodiment.

Referring to FIG. 2, the cover device 1100 according to the embodiment may include the first body 1110 and the second body 1120, and the above-described details may be applied to the first body 1110 and the second body 1120, so redundant descriptions will be omitted.

In addition, referring to FIG. 2, the second body 1120 according to the embodiment may include the first plate 1121, the second plate 1122, and the third plate 1123, and the above-described details may be applied to the above-described elements, so redundant descriptions will be omitted.

In addition, referring to FIG. 2, the cover device 1100 according to the embodiment may include the auxiliary plate 1124, and the above-described details may be applied thereto, so redundant descriptions will be omitted.

Referring back to FIG. 2, a first use state of the cover device 1100 according to the embodiment may be a state in which the target electronic device 1130 is located on the first body 1110.

For example, a first use state of the cover device 1100 according to the embodiment may be a state in which the target electronic device 1130 is located on the first body 1110 so that at least one magnetic material included in the first body 1110 is attached to the rear surface of the target electronic device 1130, but is not limited thereto.

Herein, the target electronic device 1130 may correspond to a tablet PC that is for the cover device 1100 only, but is not limited thereto.

In addition, the first use state of the cover device 1100 according to the embodiment may be a state in which the target electronic device 1130 is located on the inner surface of the first body 1110.

For example, the first use state of the cover device 1100 according to the embodiment may be a state in which the target electronic device 1130 is located on the first body 1110 to be brought in contact with the inner surface of the first body 1110, but is not limited thereto.

In addition, the first use state of the cover device 1100 according to the embodiment may be a use state in which the target electronic device 1130 is located on the first body 1110 as described above. Unlike the state shown in FIG. 2, the first use state of the cover device 1100 may be a state in which the front surface of the target electronic device 1130 is in contact with the second body 1120.

For example, the first use state of the cover device 1100 according to the embodiment may be an use state in which the target electronic device 1130 is located on the first body 1110, and the inner surfaces of the first plate 1121, the second plate 1122, and the third plate 1123 are in contact with the front surface of the target electronic device 1130, but is not limited thereto.

In addition, the first use state of the cover device 1100 may be an use state in which the target electronic device 1130 is located on the first body 1110 as described above, the second body 1120 is in contact with the front surface of the target electronic device 1130, and the auxiliary plate 1124 is attached to the first body 1110.

For example, the first use state of the cover device 1100 according to the embodiment may be an use state in which the target electronic device 1130 is located on the first body 1110, the inner surfaces of the first plate 1121, the second plate 1122, and the third plate 1123 are in contact with the front surface of the target electronic device 1130, the inner surface of the auxiliary plate 1124 is in contact with the outer surface of the first body 1110, and at least one magnetic material included in the auxiliary plate 1124 is attached to at least one magnetic material included in the first body 1110 by a magnetic force, but is not limited thereto.

Figure 3:
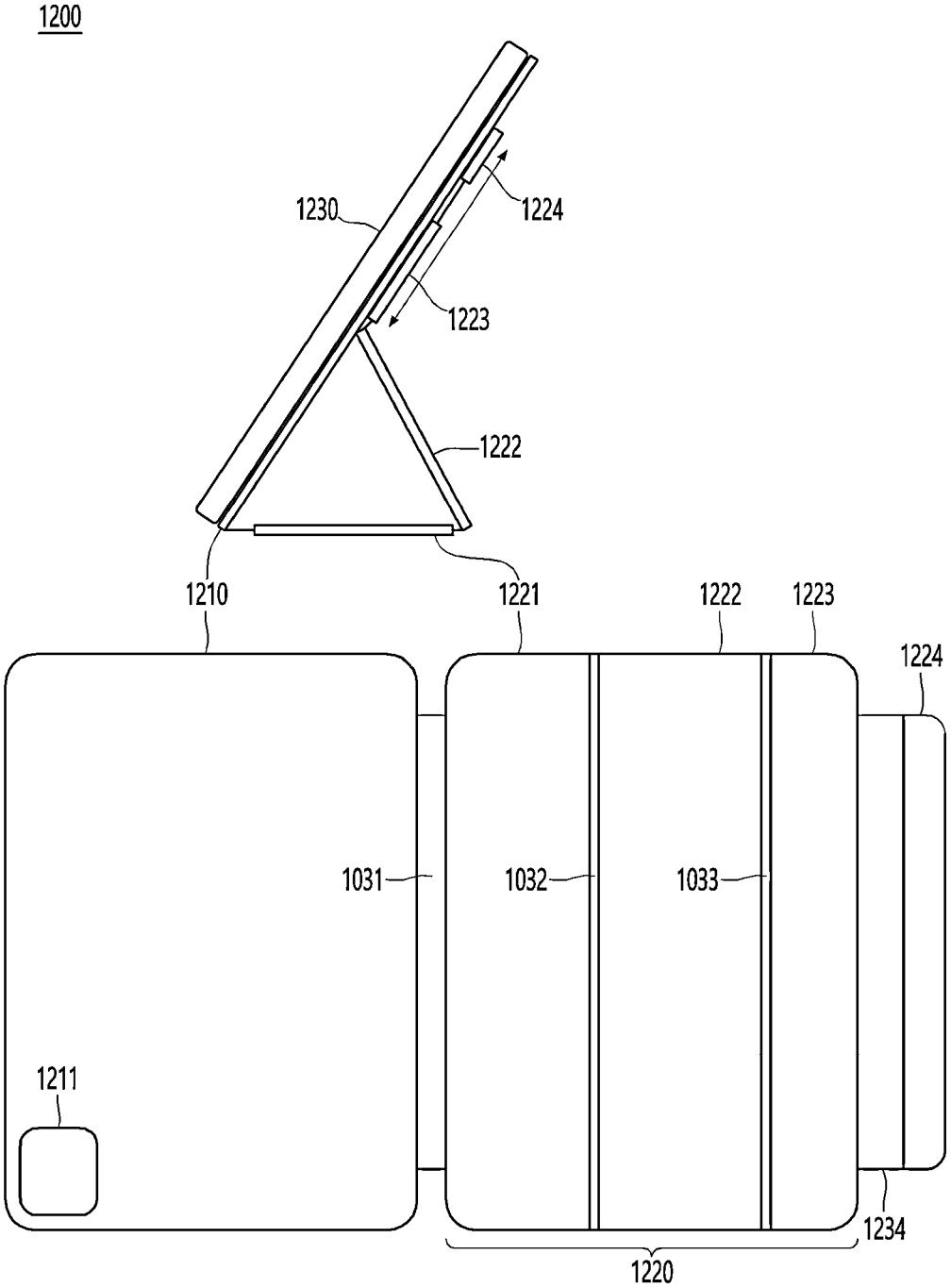
FIG. 3 is a view for illustrating a first support state of the cover device according to the embodiment.

FIG. 3 is a view for illustrating a first support state of the cover device according to the embodiment.

Referring to FIG. 3, the cover device 1200 according to the embodiment may include the first body 1210 and the second body 1220, and the above-described details may be applied to the first body 1210 and the second body 1220, so redundant descriptions will be omitted.

In addition, referring to FIG. 3, the first body 1210 according to the embodiment may include the first hole 1211, and the second body 1220 according to the embodiment may include the first plate 1221, the second plate 1222, and the third plate 1223, and the above-described details may be applied to the above-described elements, so redundant descriptions will be omitted.

In addition, referring to FIG. 3, the cover device 1200 according to the embodiment may include the auxiliary plate 1224, and the above-described details may be applied thereto, so redundant descriptions will be omitted.

In addition, referring to FIG. 3, the cover device 1200 according to the embodiment may include the first connection portion 1231, the second connection portion 1232, the third connection portion 1233, and the fourth connection portion 1234, and the above-described details may be applied thereto, so redundant descriptions will be omitted.

In addition, referring to FIG. 3, the target electronic device 1230 is shown to describe the first support state of the cover device 1200 according to the embodiment.

Referring back to FIG. 3, the first support state of the cover device 1200 according to the embodiment may be a state in which the target electronic device 1230 is located on the first body 1210 and the first body 1210 is supported by the second plate 1222.

For example, the first support state of the cover device 1200 according to the embodiment may be a state in which a first magnetic material included in the first plate 1221 and a second magnetic material included in the second plate 1222 are not attached to the first body 1210, a third magnetic material included in the third plate 1223 and a fourth magnetic material included in the auxiliary plate 1224 are attached to the first body 1210, and the first body 1210 is supported by the first connection portion 1231 and the second plate 1222, but is not limited thereto.

In addition, for example, the first support state of the cover device 1200 according to the embodiment is a state of maintaining a support state in a triangular pillar shape, and may be a state in which the first plate 1221 constitutes at least a portion of a first surface of the triangular pillar shape, the second plate 1222 constitutes at least a portion of a second surface of the triangular pillar shape, at least a portion of the first body 1210 constitutes at least a portion of a third surface of the triangular pillar shape, and the third magnetic material included in the third plate 1223 and the fourth magnetic material included in the auxiliary plate 1224 are attached to the first body 1210 in order to maintain the above-described support state, but is not limited thereto.

Herein, at least a first application point of the first body 1210 may be supported by the second plate 1222, and a second application point of the first body 1210 may be supported by the first connection portion 1231.

In addition, herein, the second plate 1222 may be supported by the second connection portion 1232, and a magnetic force between the third magnetic material included in the third plate 1223 and the first body 1210 and a magnetic force between the fourth magnetic material included in the auxiliary plate 1224 and the first body 1210.

In addition, the first support state of the cover device 1200 according to the embodiment is described based on the state in which the target electronic device 1230 is located on the first body 1210 for convenience of description, but the first support state of the cover device 1200 according to the embodiment may include a state in which the target electronic device 1230 is not located on the first body 1210 and the first body 1210 is supported by the second plate 1222.

In addition, in the first support state of the cover device 1200 according to the embodiment, an angle between the first body 1210 and the first plate 1221 may be formed within a specific angle range.

For example, in the first support state of the cover device 1200 according to the embodiment, an angle between the first body 1210 and the first plate 1221 may range from 30 degrees to 90 degrees, but is not limited thereto.

In addition, for example, in the first support state of the cover device 1200 according to the embodiment, an angle between the first body 1210 and the first plate 1221 may range from 45 degrees to 90 degrees, but is not limited thereto.

In addition, in the first support state of the cover device 1200 according to the embodiment, an angle between the first body 1210 and the first plate 1221 may vary.

For example, in the first support state of the cover device 1200 according to the embodiment, when the third magnetic material included in the third plate 1223 is attached to a first region of the first body 1210, an angle between the first body 1210 and the first plate 1221 may be a first angle, and when the third magnetic material included in the third plate 1223 is attached to a second region of the first body 1210, an angle between the first body 1210 and the first plate 1221 may be a second angle, but are not limited thereto.

In addition, for example, in the first support state of the cover device 1200 according to the embodiment, when the fourth magnetic material included in the auxiliary plate 1224 is attached to a third region of the first body 1210, an angle between the first body 1210 and the first plate 1221 may be the first angle, and when the fourth magnetic material included in the auxiliary plate 1224 is attached to a fourth region of the first body 1210, an angle between the first body 1210 and the first plate 1221 may be the second angle, but are not limited thereto.

In addition, in the first support state of the cover device 1200 according to the embodiment, an angle between the first body 1210 and the first plate 1221 may vary continuously.

For example, in the first support state of the cover device 1200 according to the embodiment, when the third magnetic material included in the third plate 1223 slides while being attached to the first body 1210, an angle between the first body 1210 and the first plate 1221 may vary continuously according to the sliding, but is not limited thereto.

In addition, for example, in the first support state of the cover device 1200 according to the embodiment, when the fourth magnetic material included in the auxiliary plate 1224 slides while being attached to the first body 1210, an angle between the first body 1210 and the first plate 1221 may vary continuously, but is not limited thereto.

In addition, in this case, the first body 1210 and the third plate 1223 may be designed to continue to maintain a magnetic force according to relative locations.

For example, the first body 1210 may be formed to include an iron plate within a range where at least the third magnetic material included in the third plate 1223 is attached and movable, but is not limited thereto.

In addition, in this case, the first body 1210 and the auxiliary plate 1224 may be designed to continue to maintain a magnetic force according to relative locations.

For example, the first body 1210 may be formed to include an iron plate within a range where at least the fourth magnetic material included in the auxiliary plate 1224 is attached and movable, but is not limited thereto.

In addition, in the first support state of the cover device 1200 according to the embodiment, an angle between the first body 1210 and the first plate 1221 may vary discontinuously (vary to be discrete).

For example, the cover device 1200 according to the embodiment may be designed so that the third magnetic material included in the third plate 1223 is attached to the first region or second region of the first body 1210 in the first support state, and when the third magnetic material is attached to the first region of the first body, an angle between the first body 1210 and the first plate 1221 may be a first angle, and when the third magnetic material is attached to the second region of the first body, an angle between the first body 1210 and the first plate 1221 may be the second angle. Accordingly, an angle between the first body 1210 and the first plate 1221 may vary discontinuously to the first angle or the second angle, but is not limited thereto.

In addition, for example, the cover device 1200 according to the embodiment may be designed so that the fourth magnetic material included in the auxiliary plate 1224 is attached to a third region or a fourth region of the first body 1210 in the first support state, and wen the fourth magnetic material is attached to the third region of the first body 1210, an angle between the first body 1210 and the first plate 1221 may be the first angle, and when the fourth magnetic material is attached to the fourth region of the first body 1210, an angle between the first body 1210 and the first plate 1221 may be the second angle. Accordingly, an angle between the first body 1210 and the first plate 1221 may vary discontinuously to the first angle or the second angle, but is not limited thereto.

Figure 4:
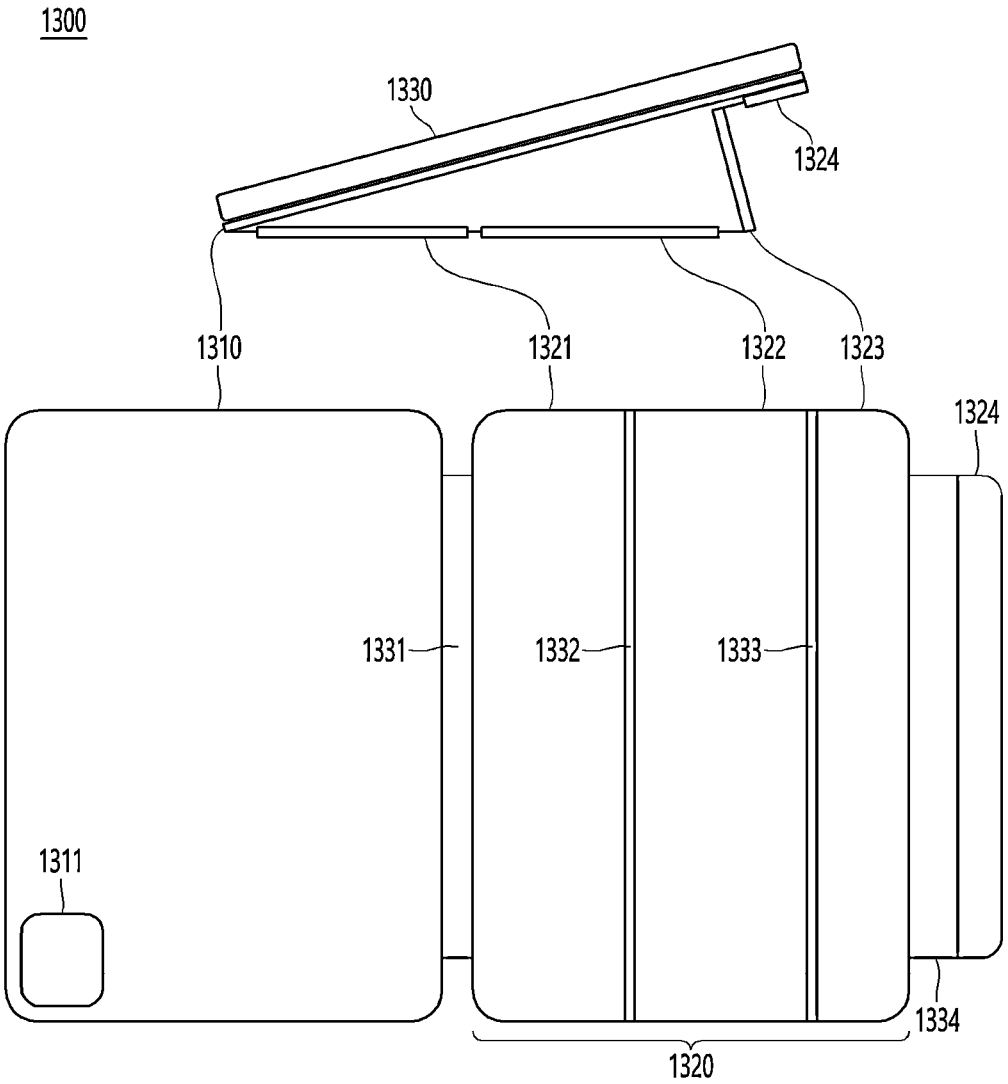
FIG. 4 is a view for illustrating a second support state of the cover device according to the embodiment.

FIG. 4 is a view for illustrating a second support state of the cover device according to the embodiment.

Referring to FIG. 4, the cover device 1300 according to the embodiment may include the first body 1310 and the second body 1320, and the above-described details may be applied to the first body 1310 and the second body 1320, so redundant descriptions will be omitted.

In addition, referring to FIG. 4, the first body 1310 according to the embodiment may include the first hole 1311. The second body 1320 according to the embodiment may include the first plate 1321, the second plate 1322, and the third plate 1323, and the above-described details may be applied to the above-described elements, so redundant descriptions will be omitted.

In addition, referring to FIG. 3, the cover device 1300 according to the embodiment may include the auxiliary plate 1324, and the above-described details may be applied thereto, so redundant descriptions will be omitted.

In addition, referring to FIG. 4, the cover device 1300 according to the embodiment may include the first connection portion 1331, the second connection portion 1332, the third connection portion 1333, and the fourth connection portion 1334, and the above-described details may be applied thereto, so redundant descriptions will be omitted.

In addition, referring to FIG. 4, the target electronic device 1330 is shown to describe a second support state of the cover device 1300 according to the embodiment.

Referring back to FIG. 4, the second support state of the cover device 1300 according to the embodiment may be a state in which the target electronic device 1330 is located on the first body 1310 and the first body 1310 is supported by the third plate 1323.

For example, the second support state of the cover device 1300 according to the embodiment may be a state in which the first magnetic material included in the first plate 1321, the second magnetic material included in the second plate 1322, and the third magnetic material included in the third plate 1323 are not attached to the first body 1310, the fourth magnetic material included in the auxiliary plate 1324 is attached to the first body 1310, and the first body 1310 is supported by the first connection portion 1331 and the third plate 1323, but is not limited thereto.

In addition, for example, the second support state of the cover device 1300 according to the embodiment is a state of maintaining a support state in a triangular pillar shape, and may be a state in which the first plate 1321 and the second plate 1322 constitute at least a portion of a first surface of the triangular pillar shape, the third plate 1323 constitutes at least a portion of a second surface of the triangular pillar shape, at least a portion of the first body 1310 constitutes at least a portion of a third surface of the triangular pillar shape, and the fourth magnetic material included in the auxiliary plate 1224 is attached to the first body 1210 in order to maintain the above-mentioned support state, but is not limited thereto.

Herein, at least a first application point of the first body 1310 may be supported by the third plate 1323, and a second application point of the first body 1310 may be supported by the first connection portion 1331.

In addition, herein, the third plate 1323 may be supported by the third connection portion 1333 and a magnetic force between the fourth magnetic material included in the auxiliary plate 1324 and the first body 1310.

In addition, the second support state of the cover device 1300 according to the embodiment is described based on the state in which the target electronic device 1330 is located on the first body 1310 for convenience of description, but the second support state of the cover device 1300 according to the embodiment may include a state in which the target electronic device 1330 is not located on the first body 1310 and the first body 1310 is supported by the third plate 1323.

In addition, in the second support state of the cover device 1300 according to the embodiment, an angle between the first body 1310 and the first plate 1321 may be formed within a specific angle range.

For example, in the second support state of the cover device 1300 according to the embodiment, an angle between the first body 1310 and the first plate 1321 may range from 10 degrees to 45 degrees, but is not limited thereto.

In addition, for example, in the second support state of the cover device 1300 according to the embodiment, an angle between the first body 1310 and the first plate 1321 may range from 10 degrees to 30 degrees, but is not limited thereto.

In addition, in the second support state of the cover device 1300 according to the embodiment, an angle between the first body 1310 and the third plate 1323 may be formed to be a specific angle.

For example, in the second support state of the cover device 1300 according to the embodiment, an angle between the first body 1310 and the third plate 1323 may be designed to be 90 degrees, but is not limited thereto.

In addition, in the second support state of the cover device 1300 according to the embodiment, when an angle between the first body 1310 and the third plate 1323 may be a specific angle, a magnetic force between the fourth magnetic material included in the auxiliary plate 1324 and the first body 1310 may be maintained.

For example, in the second support state of the cover device 1300 according to the embodiment, when an angle between the first body 1310 and the third plate 1323 may be 90 degrees, a magnetic force between the fourth magnetic material included in the auxiliary plate 1324 and the first body 1310 may be maintained, but is not limited thereto.

As described above, when the cover device 1300 according to the embodiment is designed so that an angle between the first body 1310 and the third plate 1323 in the second support state is close to 90 degrees, the third plate 1323 can better withstand a load of the target electronic device 1330 located on the first body 1310, and the second support state may be better maintained.

In addition, in the second support state of the cover device 1300 according to the embodiment, since an angle between the first body 1310 and the first plate 1321 is small, forming, by an user of the target electronic device 1330, the cover device 1300 into the second support state may be increasing of additional loads applied to the target electronic device 1330 (for example, the user can perform actions such as writing or drawing on the target electronic device 1330). Therefore, by the design as described above, the user can use the target electronic device 1330 in a desired way more conveniently and safely while maintaining an angle between the target electronic device 1330 and a floor.

In addition, in the second support state of the cover device 1300 according to the embodiment, an angle between the first body 1310 and the first plate 1321 may be variable.

In addition, for example, in the second support state of the cover device 1300 according to the embodiment, when the fourth magnetic material included in the auxiliary plate 1324 is attached to a first region of the first body 1310, an angle between the first body 1310 and the first plate 1321 may be the first angle, and when the fourth magnetic material included in the auxiliary plate 1324 is attached to a second region of the first body 1310, an angle between the first body 1310 and the first plate 1321 may be the second angle, but are not limited thereto.

In addition, in the second support state of the cover device 1300 according to the embodiment, a change rate of an angle between the first body 1310 and the first plate 1321 depending on a change rate of a region of the first body 1310 to which the auxiliary plate 1324 is attached may be smaller than a change rate of an angle between the first body 1310 and the first plate 1321 depending on a change rate of an region of the first body 1310 to which the auxiliary plate 1324 is attached in the first support state of the cover device 1300 according to the embodiment.

For example, in the second support state of the cover device 1300 according to the embodiment, when the auxiliary plate 1324 is attached to the first region of the first body 1310 and then is moved to the second region by a first distance and attached to the second region, an angle between the first body 1310 and the first plate 1321 varies to the first angle. In the second support state of the cover device 1300 according to the embodiment, when the auxiliary plate 1324 is attached to the third region of the first body 1310 and then is moved to the fourth region by the first distance and attached to the fourth region, an angle between the first body 1310 and the first plate 1321 varies to the second angle, and the first angle may be larger than the second angle, but are not limited thereto.

Figure 5:
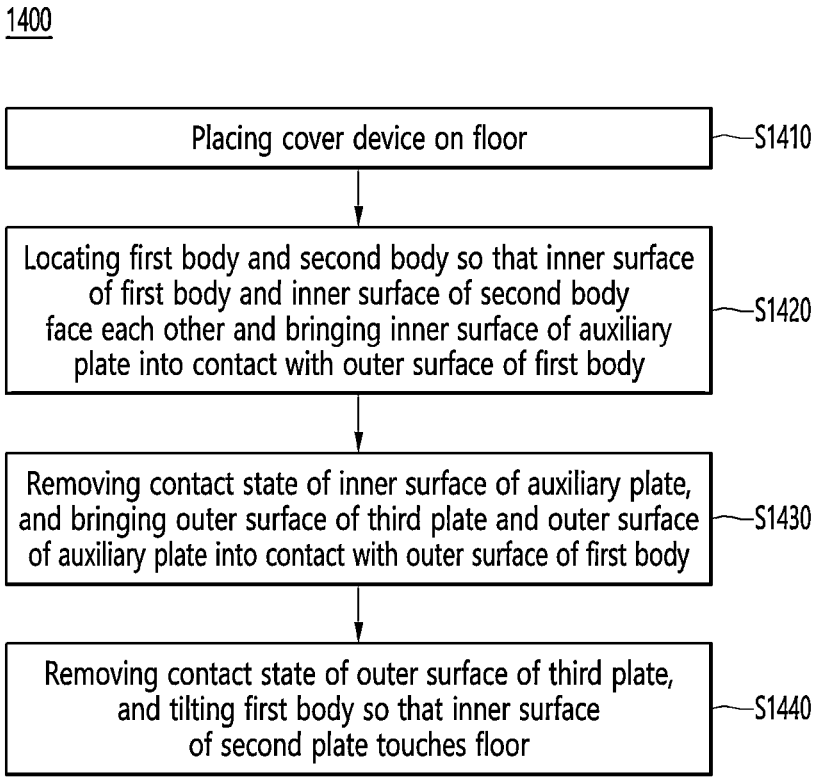
FIG. 5 is a view for illustrating a method for using the cover device according to the embodiment.

FIG. 5 is a view for illustrating a method for using the cover device according to the embodiment.

Prior to description of FIG. 5, the cover device which is an object of a use method described from FIG. 5 may correspond to the above-described interface device.

Herein, the cover device may include the first body, the second body, and the auxiliary plate, and the first body may include the hole for locating a camera module of the target electronic device and the magnetic material, and the second body may include the first plate, the second plate, and the third plate, and the second body may have the same size as the first body.

In addition, herein, the above-described details may be applied to the above-described elements, so redundant descriptions will be omitted.

Referring to FIG. 5, a method 1400 for using the cover device according to the embodiment may include: at least one of placing the cover device on the floor S1410; locating the first body and the second body so that the inner surface of the first body and the inner surface of the second body face each other, and bringing the inner surface of the auxiliary plate into contact with the outer surface of the first body S1420; removing the contact state of the inner surface of the auxiliary plate, and bringing the outer surface of the third plate and the outer surface of the auxiliary plate into contact with the outer surface of the first body S1430; and removing the contact state of the outer surface of the third plate, and tilting the first body so that the inner surface of the second plate touches the floor S1440.

Herein, the floor may be a variety of objects such as ground, an upper surface of a desk, a floor of a building, etc. which function to enable the interface device to maintain a potential energy due to Earth's gravity.

In addition, the placing of the cover device according to the embodiment on the floor S1410 may be performed by providing the cover device to a specific region for using the cover device, but is not limited thereto.

In addition, in the placing of the cover device according to the embodiment on the floor S1410, the target electronic device may be located on the inner surface of the first body of the cover device, but is not limited thereto.

In addition, according to the embodiment, in the locating the first body and the second body so that the inner surface of the first body and the inner surface of the second body face each other and bringing the inner surface of the auxiliary plate into contact with the outer surface of the first body at S1420, the target electronic device may be located on the inner surface of the first body of the cover device, the second body may cover the target electronic device, and at least a portion of the second body may be brought into contact with the target electronic device, but are not limited thereto.

In addition, according to the embodiment, in the locating the first body and the second body so that the inner surface of the first body and the inner surface of the second body face each other and bringing the inner surface of the auxiliary plate into contact with the outer surface of the first body at S1420, the fourth magnetic material included in the auxiliary plate may be attached to the first body.

Herein, the attaching the fourth magnetic material to the first body may be a state in which a relative position between the fourth magnetic material and the first body is maintained by a magnetic force between the fourth magnetic material and at least a portion of the first body, but is not limited thereto.

In addition, according to the embodiment, in the locating the first body and the second body so that the inner surface of the first body and the inner surface of the second body face each other and the bringing the inner surface of the auxiliary plate into contact with the outer surface of the first body at S1420, the first to third magnetic materials included in the first to third plates included in the second body may not be attached to the first body.

In addition, according to the embodiment, the locating the first body and the second body so that the inner surface of the first body and the inner surface of the second body face each other and bringing the inner surface of the auxiliary plate into contact with the outer surface of the first body at S1420 may be performed by forming an use state for protecting the target electronic device located between the inner surface of the first body and the inner surface of the second body, but is not limited thereto.

In addition, according to the embodiment, in the removing the contact state of the inner surface of the auxiliary plate and bringing the outer surface of the third plate and the outer surface of the auxiliary plate in contact with the outer surface of the first body at S1430, the removing the contact state of the inner surface of the auxiliary plate may be movement of removing the contact state between the inner surface of the auxiliary plate and the outer surface of the first body, and may be movement of increasing a distance between the fourth magnetic material and the first body to weaken a magnetic force between the fourth magnetic material included in the auxiliary plate and at least a portion of the first body, but is not limited thereto.

In addition, according to the embodiment, in the removing the contact state of the inner surface of the auxiliary plate and bringing the outer surface of the third plate and the outer surface of the auxiliary plate in contact with the outer surface of the first body at S1430, the third plate may be attached to the first body.

In addition, according to the embodiment, in the removing the contact state of the inner surface of the auxiliary plate and bringing the outer surface of the third plate and the outer surface of the auxiliary plate in contact with the outer surface of the first body at S1430, the outer surface of the third plate is brought into contact with the outer surface of the first body, and a relative position relationship between the outer surface of the third plate and the outer surface of the first body may be maintained by a magnetic force between the third magnetic material included in the third plate and the magnetic material included in the first body, but is not limited thereto.

In addition, according to the embodiment, in the removing the contact state of the inner surface of the auxiliary plate and bringing the outer surface of the third plate and the outer surface of the auxiliary plate in contact with the outer surface of the first body at S1430, the auxiliary plate may be attached to the first body.

In addition, according to the embodiment, in the removing the contact state of the inner surface of the auxiliary plate and bringing the outer surface of the third plate and the outer surface of the auxiliary plate in contact with the outer surface of the first body at S1430, the outer surface of the auxiliary plate is brought into contact with the outer surface of the first body, and a relative position relationship between the outer surface of the auxiliary plate and the outer surface of the first body may be maintained by a magnetic force between the fourth magnetic material included in the auxiliary plate and the magnetic material included in the first body, but are not limited thereto.

In addition, according to the embodiment, in the removing the contact state of the inner surface of the auxiliary plate and bringing the outer surface of the third plate and the outer surface of the auxiliary plate in contact with the outer surface of the first body at S1430, the third plate and the auxiliary plate may be located on the same level.

In addition, according to the embodiment, in the removing the contact state of the inner surface of the auxiliary plate and bringing the outer surface of the third plate and the outer surface of the auxiliary plate in contact with the outer surface of the first body at S1430, the first body may be supported by the second plate.

In addition, according to the embodiment, in the removing the contact state of the inner surface of the auxiliary plate and bringing the outer surface of the third plate and the outer surface of the auxiliary plate in contact with the outer surface of the first body at S1430, the inner surface of the first plate may touch the floor.

In addition, according to the embodiment, the removing the contact state of the inner surface of the auxiliary plate and bringing the outer surface of the third plate and the outer surface of the auxiliary plate in contact with the outer surface of the first body at S1430 may be performed by forming the first support state of the cover device which is described through FIG. 3, and descriptions to be mentioned for the first support state has been mentioned so redundant descriptions will be omitted.

In addition, according to the embodiment, it may be understood that the removing the contact state of the inner surface of the auxiliary plate and bringing the outer surface of the third plate and the outer surface of the auxiliary plate in contact with the outer surface of the first body at S1430 is performed by changing an use state of the cover device from the above-described first use state to the first support state of the cover device described through FIG. 3, but is not limited thereto.

In addition, according to the embodiment, in the removing the contact state of the outer surface of the third plate and tilting the first body so that the inner surface of the second plate touches the floor at S1440, the removing a contact state of the outer surface of the third plate may be movement of removing a contact state between the outer surface of the third plate and the outer surface of the first body, and may be movement of increasing a distance between the third magnetic material and the first body to weaken a magnetic force between the third magnetic material included in the third plate and at least a portion of the first body, but is not limited thereto.

In addition, according to the embodiment, in the removing the contact state of the outer surface of the third plate and tilting the first body so that the inner surface of the second plate touches the floor at S1440, the auxiliary plate may be attached to the first body.

For example, according to the embodiment, in the removing the contact state of the outer surface of the third plate and tilting the first body so that the inner surface of the second plate touches the floor at S1440, the outer surface of the auxiliary plate is brought into contact with the outer surface of the first body, and a relative position relationship between the outer surface of the auxiliary plate and the outer surface of the first body may be maintained by a magnetic force between the fourth magnetic material included in the auxiliary plate and the magnetic material included in the first body, but are not limited thereto.

In addition, according to the embodiment, in the removing the contact state of the outer surface of the third plate and tilting the first body so that the inner surface of the second plate touches the floor at S1440, the first body may be supported by the third plate.

In addition, according to the embodiment, in the removing the contact state of the outer surface of the third plate and tilting the first body so that the inner surface of the second plate touches the floor at S1440, as the first body is tilted, an angle between the first body and the first plate may be reduced.

In addition, according to the embodiment, in the removing the contact state of the outer surface of the third plate and tilting the first body so that the inner surface of the second plate touches the floor at S1440, as the inner surface of the second plate touches the floor, the first plate and the second plate may be placed on the same level.

In addition, according to the embodiment, in the removing the contact state of the outer surface of the third plate and tilting the first body so that the inner surface of the second plate touches the floor at S1440 may be performed by forming the second support state of the cover device which is described through FIG. 4, and descriptions to be mentioned for the second support state have been mentioned, so redundant descriptions will be omitted.

In addition, according to the embodiment, in the removing the contact state of the outer surface of the third plate and tilting the first body so that the inner surface of the second plate touches the floor at S1440 may be performed by changing a support state of the cover device from the first support state of the cover device described through FIG. 3 to the second support state of the cover device described through FIG. 4, but is not limited thereto.

Figure 6:
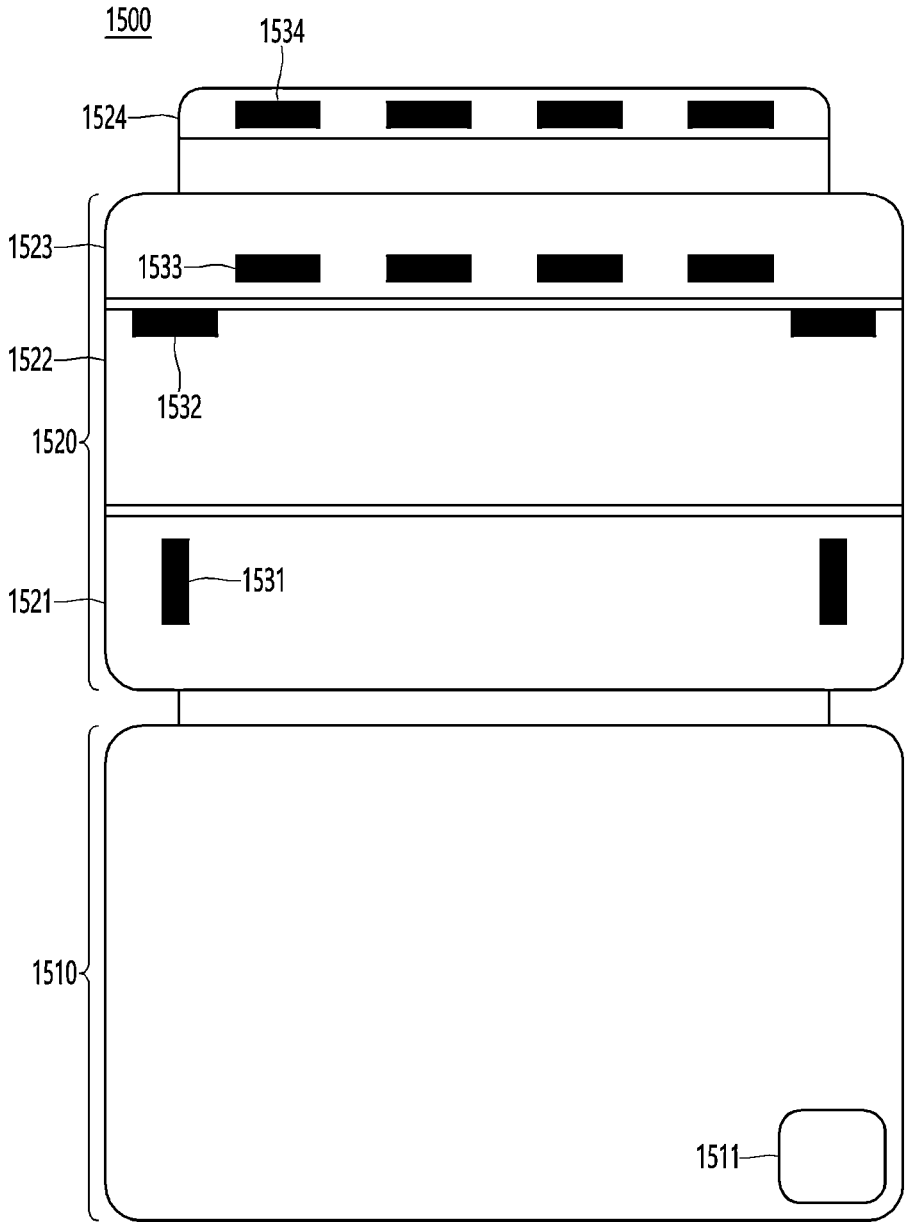
FIG. 6 is a view for illustrating magnetic materials included in the cover device according to the embodiment.

FIG. 6 is a view for illustrating magnetic materials included in the cover device according to the embodiment.

Referring to FIG. 6, the cover device 1500 according to the embodiment may include the first body 1510 and the second body 1520, and the above-described details may be applied the above-described configuration, so redundant descriptions will be omitted.

In addition, referring to FIG. 6, the first body 1510 according to the embodiment may include the first hole 1511, and the above-described details may be applied to the above-described elements, so redundant descriptions will be omitted.

In addition, referring to FIG. 6, the second body 1520 according to the embodiment may include the first plate 1521, the second plate 1522, and the third plate 1523, and the above-described details may be applied to the above-described elements, so redundant descriptions will be omitted.

In addition, referring to FIG. 6, the cover device 1500 according to the embodiment may include the auxiliary plate 1524, and the above-described details may be applied to the above-mentioned configuration, so redundant descriptions will be omitted.

Referring back to FIG. 6, at least a portion of each of the first to third plates 1521 to 1523 included in the cover device 1500 according to the embodiment may be formed to include a magnetic material.

For example, according to the embodiment, the first plate 1521 may include the first magnetic material 1531, and the first magnetic material 1531 may be located in a first region of the first plate 1521, but are not limited thereto.

Herein, at least a portion of the first region may be a region that is overlapped with an imaginary center line with respect to the width of the first plate 1521, but is not limited thereto.

In addition, the first region may be a region spaced apart from the imaginary center line with respect to the width of the first plate 1521 by a predetermined distance, but is not limited thereto.

In addition, herein, the first magnetic material 1531 may be disposed in a first direction, but is not limited thereto.

In addition, for example, according to the embodiment, the second plate 1522 may include the second magnetic material 1532, and the second magnetic material 1532 may be located in a second region of the second plate 1522.

Herein, the second region may be a region close to one end of the second plate 1522, but is not limited thereto.

In addition, herein, the second magnetic material 1532 may be disposed in a second direction, and the second direction may be a direction perpendicular to the first direction, but is not limited thereto.

In addition, for example, according to the embodiment, the third plate 1523 may include the third magnetic material 1533, and the third magnetic material 1533 may be located in a third region of the third plate 1523.

Herein, the third region may be a region that is closer to an imaginary center line with respect to the width of the third plate 1523 than one end of the third plate 1523, but is not limited thereto.

In addition, herein, the third magnetic material 1533 may be disposed in a third direction, and the third direction may be a direction perpendicular to the first direction and parallel to the second direction, but are not limited thereto.

In addition, at least a portion of the auxiliary plate 1524 included in the cover device 1500 according to the embodiment may include a magnetic material.

For example, according to the embodiment, the auxiliary plate 1524 may include the fourth magnetic material 1534, and the fourth magnetic material 1534 may be located in a fourth region of the auxiliary plate 1524.

Herein, at least a portion of the fourth region may be a region overlapped with an imaginary center line with respect to the width of the auxiliary plate 1524, but is not limited thereto.

In addition, herein, the fourth magnetic material 1534 may be disposed in a fourth direction, and the fourth direction may be a direction perpendicular to the first direction and parallel to the second direction and the third direction, but are not limited thereto.

In addition, herein, the fourth direction may be a direction corresponding to the third direction, but is not limited thereto.

In addition, according to the embodiment, the shape and the size of the fourth magnetic material 1534 may correspond to the shape and the size of the third magnetic material 1533, but are not limited thereto.

In addition, the first body 1510 included in the cover device 1500 according to the embodiment may include at least one plate-shaped magnetic material.

For example, the first body 1510 included in the cover device 1500 according to the embodiment may include an iron plate, but is not limited thereto.

In addition, when the first body 1510 included in the cover device 1500 according to the embodiment is provided to include at least one plate-shaped magnetic material, in the first support state described above through FIG. 3, as the third plate 1523 is moved, an angle between the first body 1510 and the first plate 1521 may vary continuously.

For example, when the first body 1510 included in the cover device 1500 according to the embodiment is provided to include at least one plate-shaped magnetic material, as the third plate 1523 is moved within a range where the third magnetic material 1533 included in the third plate 1523 is moved while being attached to at least one plate-shaped magnetic material included in the first body 1510, an angle between the first body 1510 and the first plate 1521 may vary continuously, but is not limited thereto.

In addition, when the first body 1510 included in the cover device 1500 according to the embodiment is provided to include at least one plate-shaped magnetic material, in the first support state described above through FIG. 3, as the auxiliary plate 1524 is moved, an angle between the first body 1510 and the first plate 1521 may vary continuously.

For example, when the first body 1510 included in the cover device 1500 according to the embodiment is provided to include at least one plate-shaped magnetic material, as the auxiliary plate 1524 is moved within a range where the fourth magnetic material 1534 included in the auxiliary plate 1524 is moved while being attached to at least one plate-shaped magnetic material included in the first body 1510, an angle between the first body 1510 and the first plate 1521 may vary continuously, but is not limited thereto.

In addition, when the first body 1510 included in the cover device 1500 according to the embodiment is provided to include at least one plate-shaped magnetic material, in the second support state described above through FIG. 4, as the auxiliary plate 1524 is moved, an angle between the first body 1510 and the first plate 1521 may vary continuously.

For example, when the first body 1510 included in the cover device 1500 according to the embodiment is provided to include at least one plate-shaped magnetic material, as the auxiliary plate 1524 is moved within a range where the fourth magnetic material 1534 included in the auxiliary plate 1524 is moved while being attached to at least one plate-shaped magnetic material included in the first body 1510, an angle between the first body 1510 and the first plate 1521 may vary continuously, but is not limited thereto.

Figure 7:
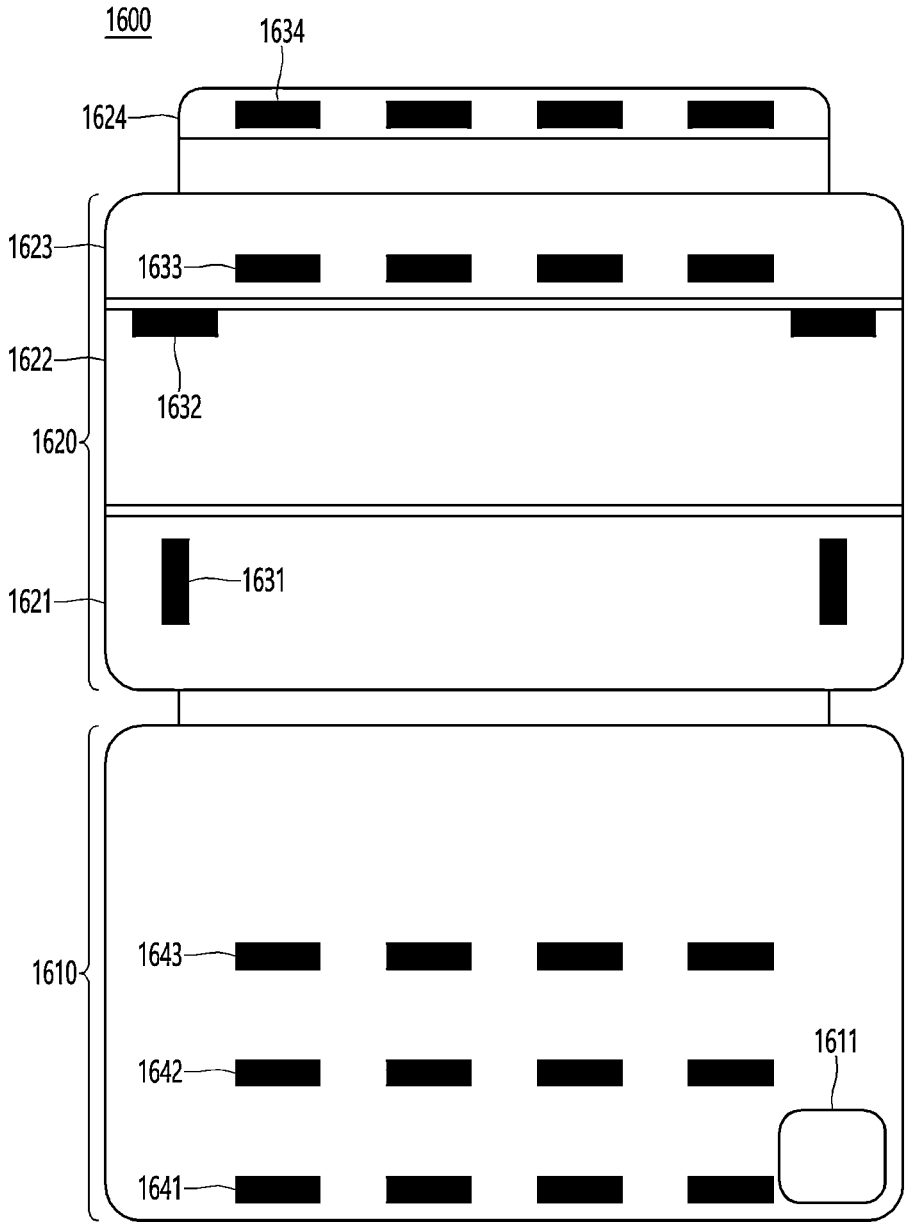
FIG. 7 is a view for illustrating magnetic materials included in the cover device according to the embodiment.

FIG. 7 is a view for illustrating magnetic materials included in the cover device according to the embodiment.

Referring to FIG. 7, the cover device 1600 according to the embodiment may include the first body 1610 and the second body 1620, and the above-described details may be applied the above-described configuration, so redundant descriptions will be omitted.

In addition, referring to FIG. 7, the first body 1610 according to the embodiment may include the first hole 1611, and the above-described details may be applied to the above-described elements, so redundant descriptions will be omitted.

In addition, referring to FIG. 7, the second body 1620 according to the embodiment may include the first plate 1621, the second plate 1622, and the third plate 1623, and the above-described details may be applied to the above-described elements, so redundant descriptions will be omitted.

In addition, referring to FIG. 7, the cover device 1600 according to the embodiment may include the auxiliary plate 1624, and the above-described details may be applied to the above-described configuration, so redundant descriptions will be omitted.

In addition, referring to FIG. 7, according to the embodiment, the first plate 1621 may include the first magnetic material 1631, the second plate 1622 may include the second magnetic material 1632, the third plate 1623 may include the third magnetic material 1633, and the auxiliary plate 1624 may include the fourth magnetic material 1634, and the above-described details may be applied to the above-described elements, so redundant descriptions will be omitted.

Referring back to FIG. 7, at least a portion of the first body 1610 included in the cover device 1600 according to the embodiment may be formed to include a magnetic material.

For example, the first body 1610 included in the cover device 1600 according to the embodiment may include a fifth magnetic material 1641 located in a fifth region, a sixth magnetic material 1642 located in a sixth region, and a seventh magnetic material 1643 located in a seventh region, but is not limited thereto.

Herein, the fifth to seventh regions may be regions corresponding to the third region where the third magnetic material 1633 is disposed on the basis of a longitudinal direction of the cover device 1600, but are not limited thereto.

In addition, herein, the fifth to seventh regions may be regions corresponding to the fourth region where the fourth magnetic material 1634 is disposed on the basis of the longitudinal direction of the cover device 1600, but are not limited thereto.

In addition, herein, the fifth to seventh magnetic materials 1641 to 1643 may be disposed in a direction parallel to a direction in which the third magnetic material 1633 is disposed, but are not limited thereto.

In addition, herein, the fifth to seventh magnetic materials 1641 to 1643 may be disposed in a direction parallel to a direction in which the fourth magnetic material 1634 is disposed, but are not limited thereto.

In addition, herein, a distance between the fifth magnetic material 1641 and the sixth magnetic material 1642 may correspond to a distance between the third magnetic material 1633 and the fourth magnetic material 1634.

In addition, herein, a distance between the sixth magnetic material 1642 and the seventh magnetic material 1643 may correspond to the distance between the third magnetic material 1633 and the fourth magnetic material 1634.

In addition, when the first body 1610 included in the cover device 1600 according to the embodiment is provided to include multiple magnetic materials, in the first support state described above through FIG. 3, as the third plate 1623 is moved, an angle between the first body 1610 and the first plate 1621 may vary discontinuously.

For example, when the third magnetic material 1633 included in the third plate 1623 is attached to the sixth magnetic material 1642 included in the first body 1610, an angle between the first body 1610 and the first plate 1621 in the first support state mentioned above may be a first angle, and when the third magnetic material 1633 included in the third plate 1623 is attached to the seventh magnetic material 1643 included in the first body 1610, an angle between the first body 1610 and the first plate 1621 in the first support state may be a second angle, and the first angle and the second angle may be disconnected, but are not limited thereto.

In addition, when the first body 1610 included in the cover device 1600 according to the embodiment is provided to include multiple magnetic materials, in the first support state described above through FIG. 3, as the auxiliary plate 1624 is moved, an angle between the first body 1610 and the first plate 1621 may vary discontinuously.

For example, when the fourth magnetic material 1634 included in the auxiliary plate 1624 is attached to the fifth magnetic material 1642 included in the first body 1610, an angle between the first body 1610 and the first plate 1621 in the first support state mentioned above may be a first angle, and when the fourth magnetic material 1634 included in the auxiliary plate 1624 is attached to the sixth magnetic material 1643 included in the first body 1610, an angle between the first body 1610 and the first plate 1621 in the first support state may be a second angle, and the first angle and the second angle may be disconnected, but are not limited thereto.

In addition, when the first body 1610 included in the cover device 1600 according to the embodiment is provided to include multiple magnetic materials, in the second support state described above through FIG. 4, as the auxiliary plate 1624 is moved, an angle between the first body 1610 and the first plate 1621 may vary discontinuously.

For example, when the fourth magnetic material 1634 included in the auxiliary plate 1624 is attached to the fifth magnetic material 1642 included in the first body 1610, an angle between the first body 1610 and the first plate 1621 in the second support state described above may be a third angle, and when the fourth magnetic material 1634 included in the auxiliary plate 1624 is attached to the sixth magnetic material 1643 included in the first body 1610, an angle between the first body 1610 and the first plate 1621 in the second support state may be a fourth angle, and the third angle and the fourth angle may be disconnected, but are not limited thereto.

Figure 8:
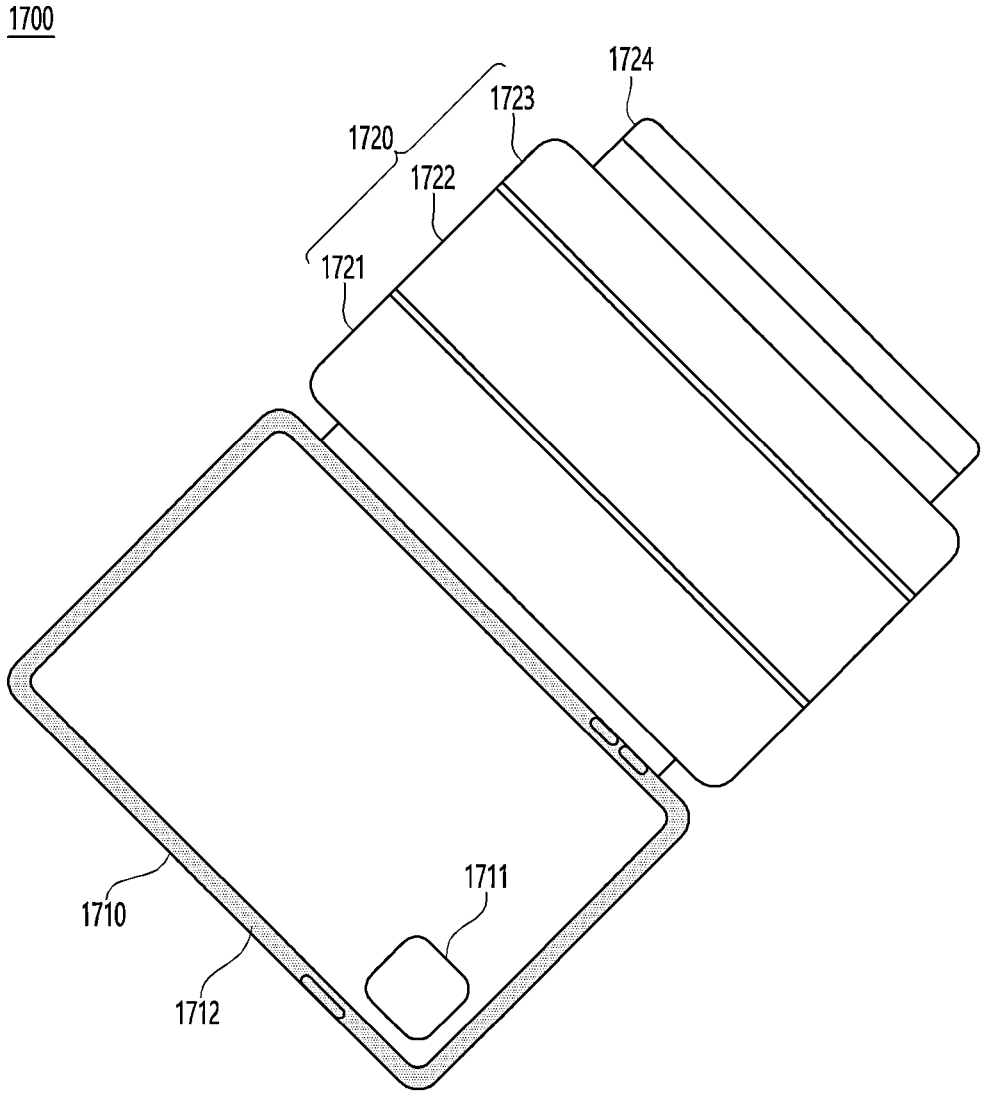
FIG. 8 is a view for illustrating the cover device according to the embodiment.

FIG. 8 is a view for illustrating the cover device according to the embodiment.

Referring to FIG. 8, the cover device 1700 according to the embodiment may include the first body 1710 and the second body 1720, and the above-described details may be applied to the first body 1710 and the second body 1720, so redundant descriptions will be omitted.

In addition, referring to FIG. 8, the first body 1710 according to the embodiment may include the first hole 1711. The second body 1720 according to the embodiment may include the first plate 1721, the second plate 1722, and the third plate 1723, and the above-described details may be applied to the above-described elements, so redundant descriptions will be omitted.

In addition, referring to FIG. 8, the cover device 1700 according to the embodiment may include the auxiliary plate 1724, and the above-described details may be applied thereto, so redundant descriptions will be omitted.

Referring back to FIG. 8, the first body 1710 included in the cover device 1700 according to the embodiment may have a casing shape for fixing or protecting the target electronic device.

For example, referring to FIG. 8, the first body 1710 included in the cover device 1700 according to the embodiment may include a protection portion 1712 for fixing or protecting the target electronic device, and the protection portion 1712 may be provided into a shape which can surround an edge of the target electronic device, but is not limited thereto.

In addition, according to the embodiment, the protection portion 1712 may be provided into various forms for fixing or protecting the target electronic device, may be provided into a form for fixing and protecting edges of the target electronic device, and may be provided into a form which can surround the edges of the target electronic device, but the protection portion 1712 is not limited thereto, and the protection portion 1712 may be provided into various forms for fixing or protecting the target electronic device.

In addition, according to the embodiment, the protection portion 1712 may be made of various materials to fix or protect the target electronic device.

For example, according to the embodiment, the protection portion 1712 may be made of silicone, etc., but is not limited thereto, and the protection portion 1712 may be made of various materials to fix or protect the target electronic device.

When the first body 1910 is provided into the form of a casing for fixing or protecting the target electronic device according to the embodiment, the target electronic device can be protected from physical impact with respect to the target electronic device, and in the first support state or the second support state which are mentioned above, the convenience of use of a user can be provided by more stably fixing the target electronic device.

Figure 9:
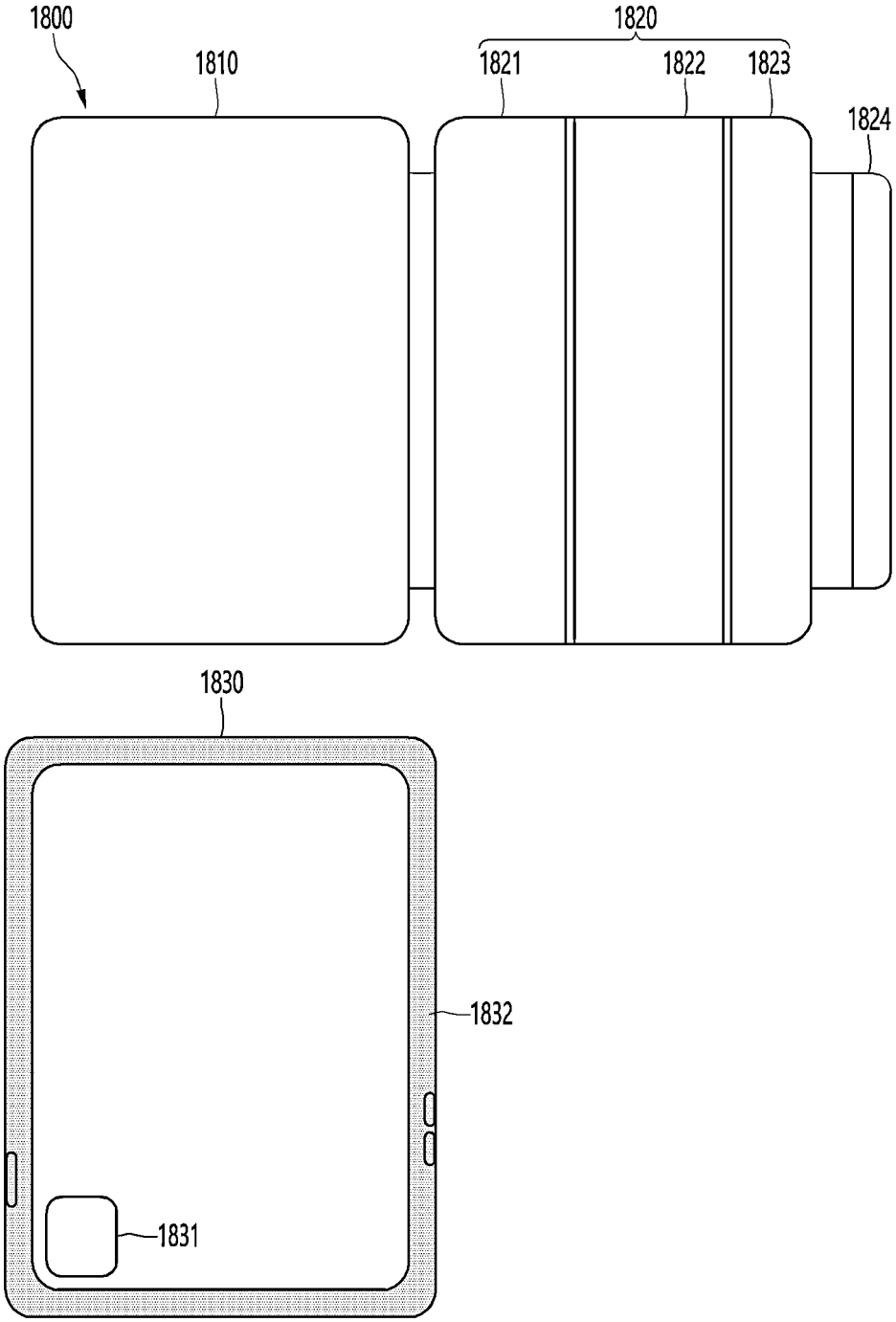
FIG. 9 is a view for illustrating a cover device set according to the embodiment.

FIG. 9 is a view for illustrating a cover device set according to the embodiment.

Referring to FIG. 9, according to the embodiment, a cover device set may include the cover device 1800 and a casing device 1830.

In addition, referring to FIG. 9, the cover device 1800 according to the embodiment may include the first body 1810 and the second body 1820, and the above-described details may be applied to the first body 1810 and the second body 1820, so redundant descriptions will be omitted.

In addition, referring to FIG. 9, the second body 1820 according to the embodiment may include the first plate 1821, the second plate 1822, and the third plate 1823, and the above-described details may be applied to the above-described elements, so redundant descriptions will be omitted.

In addition, referring to FIG. 9, the cover device 1800 according to the embodiment may include the auxiliary plate 1824, and the above-described details may be applied thereto, so redundant descriptions will be omitted.

Referring back to FIG. 9, according to the embodiment, the casing device 1830 may include at least one hole.

For example, the first body 1830 according to the embodiment may include a first hole 1831, but is not limited thereto.

In addition, at least one hole included in the casing device 1830 according to the embodiment may be a hole for passing a camera of the target electronic device.

For example, the first hole 1831 included in the casing device 1830 according to the embodiment may be a hole for passing a camera of the target tablet PC, but is not limited thereto.

In addition, the casing device 1830 according to the embodiment may perform a function for fixing or protecting the target electronic device.

For example, the casing device 1830 according to the embodiment may include a protection portion 1832 for fixing or protecting the target electronic device, and the protection portion 1832 may perform a function for fixing or protecting the target electronic device, but is not limited thereto.

In addition, according to the embodiment, the protection portion 1832 included in the casing device 1830 may be provided into various forms for fixing or protecting the target electronic device, may be provided into a form for fixing and protecting edges of the target electronic device, and may be provided into a form which can surround the edges of the target electronic device, but is not limited thereto, and the protection portion may be provided into various forms for fixing or protecting the target electronic device.

In addition, according to the embodiment, the casing device 1830 may be made of various materials to fix or protect the target electronic device.

For example, according to the embodiment, the casing device 1830 may be made of silicone, etc., but is not limited thereto, and the casing device 1830 may be made of various materials to fix or protect the target electronic device.

In addition, the cover device set according to the embodiment may enable the target electronic device to be used in more various use states than the cover device described from FIGS. 1 to 8.

Hereinafter, the cover device set will be described in detail with reference to FIGS. 10 and 11.

In addition, in order to use the cover device set according to the embodiment in more various use states, the casing device 1830 according to the embodiment may include at least one magnetic material.

For example, the casing device 1830 according to the embodiment may include magnetic material to be attached to the first body 1810 included in the cover device 1800 according to the embodiment, but is not limited thereto.

In addition, in order to use the cover device set according to the embodiment in more various use state, at least one magnetic material included in the casing device 1830 according to the embodiment may be located to correspond to at least a specific location.

For example, the magnetic material included in the casing device 1830 according to the embodiment may be located in a region which is an overlapped region between a first region which is an overlapped region of the casing device 1830 when the casing device 1830 is located in parallel to the first body 1810 and a second region which is an overlapped region of the casing device 1830 when the casing device 1830 is located perpendicular to the first body 1810, but is not limited thereto.

In addition, in order to use the cover device set according to the embodiment in more various use states, the casing device 1830 according to the embodiment may include a plate having a sheet form, and the plate provided into a sheet form may be made of a magnetic material such as an iron plate.

FIGS. 10 and 11 are views for illustrating states of use of the cover device set according to the embodiment.

Figure 10A:
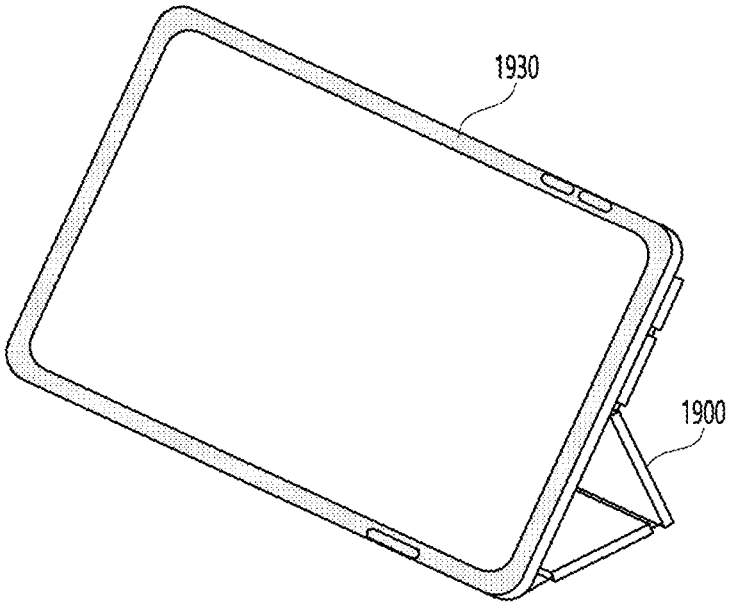
FIGS. 10A, 10B, 11A and 11B are views for illustrating states of use of the cover device set according to the embodiment.
Figure 10B:
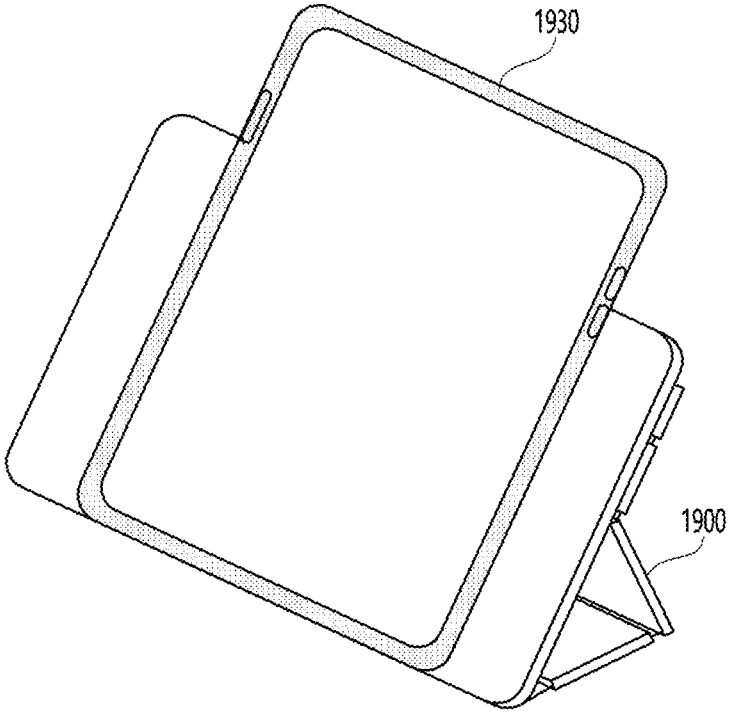
Figure 11A:
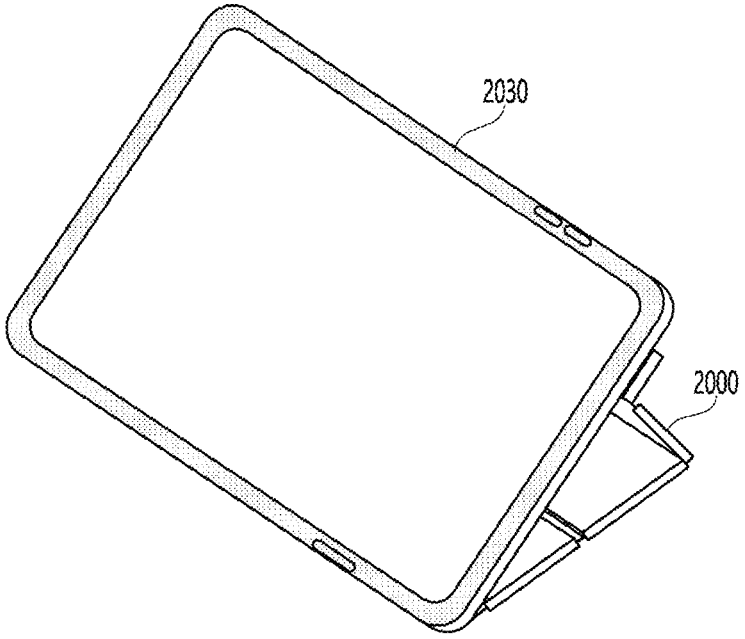
Figure 11B:
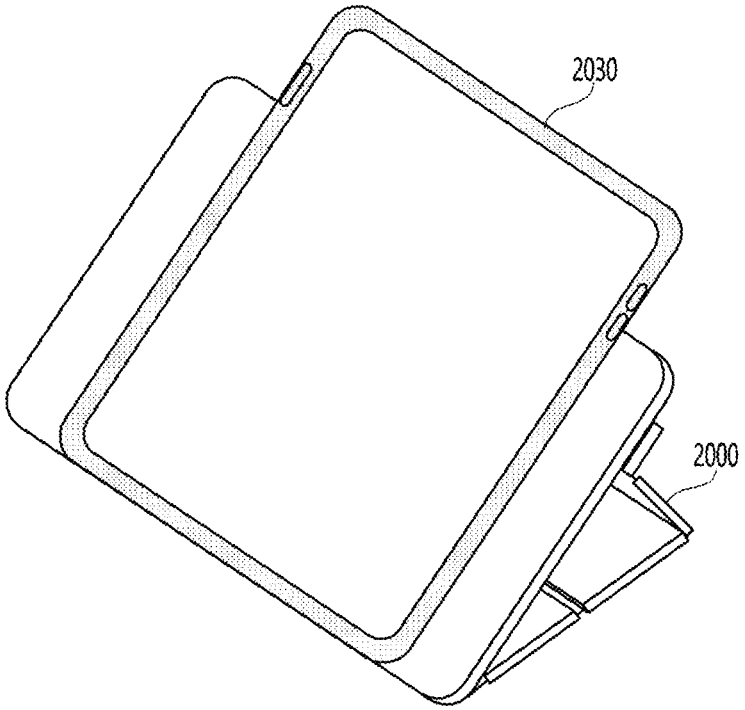

More specifically, FIGS. 10A and 10B are views illustrating use states based on the first support state of the cover device described from FIG. 3. FIGS. 11A and 11B are views illustrating use states based on the second support state of the cover device described from FIG. 4.

Referring to FIGS. 10A and 10B, the cover device set according to the embodiment may include the cover device 1900 and the casing device 1930, and the above-described details may be applied to the cover device 1900 and the casing device 1930, so redundant descriptions will be omitted.

Referring to FIG. 10A, a first use state of the cover device set according to the embodiment may be a use state in which the casing device 1930 is used by being located horizontally in the first support state of the cover device 1900.

In addition, referring to FIG. 10B, the second use state of the cover device set according to the embodiment may be a user state in which the casing device 1930 is positioned vertically to be used in the first support state of the cover device 1900.

Therefore, referring to FIGS. 10A and 10B, the user can use the target electronic device by mounting a screen of the target electronic device vertically or horizontally in the first support state of the cover device 1900 according to the user's convenience, which can provide more convenient user experience.

In addition, referring to FIGS. 11A and 11B, the cover device set according to the embodiment may include the cover device 2000 and the casing device 2030, and the above-described details may be applied to the cover device 2000 and the casing device 2030, so redundant descriptions will be omitted.

In addition, referring to FIG. 11A, a third use state of the cover device set according to the embodiment may be a use state in which the casing device 2030 is used by being located horizontally in the second support state of the cover device 2000.

In addition, referring to FIG. 11B, a fourth use state of the cover device set according to the embodiment may be a use state in which the casing device 2030 is used by being located vertically in the second support state of the cover device 2000.

Therefore, referring to FIGS. 11A and 11B, the user can use the target electronic device by mounting a screen of the target electronic device vertically or horizontally in the second support state of the cover device 2000 according to the user's convenience, which can provide more convenient user experience.

Figure 12:
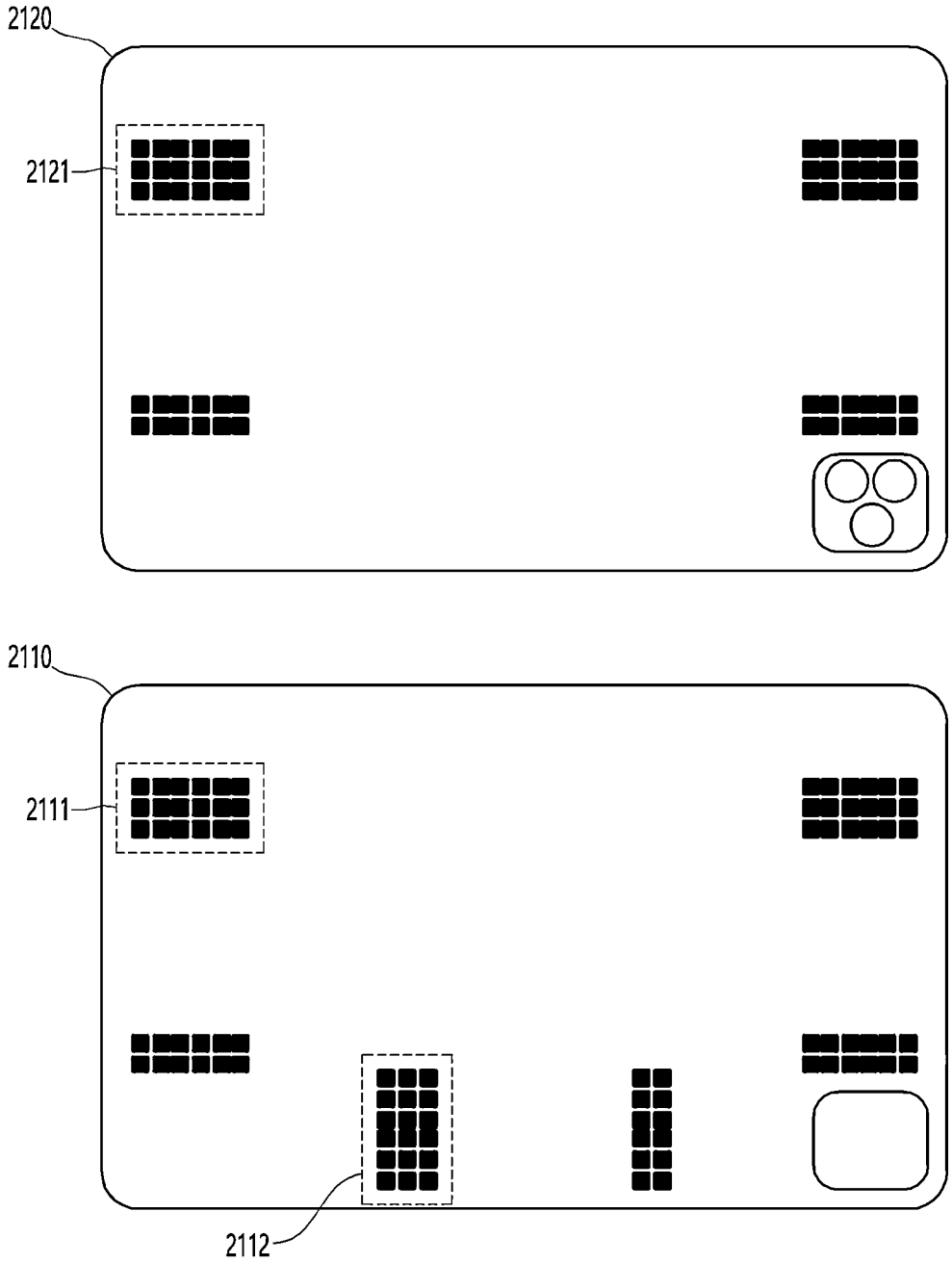
FIG. 12 is a view for illustrating magnetic materials included in the cover device according to the embodiment.

FIG. 12 is a view for illustrating magnetic materials included in the cover device according to the embodiment.

More specifically, FIG. 12 is a view illustrating a magnetic material included in the target electronic device to illustrate the magnetic material included in the cover device according to the embodiment.

Referring to FIG. 12, the first body 2110 and the target electronic device 2120 included in the cover device according to the embodiment are shown.

The above-described details may be applied to the cover device according to the embodiment and the first body 2110 included in the cover device, so redundant descriptions will be omitted.

Referring back to FIG. 12, at least one region of the target electronic device 2120 according to the embodiment may include at least one magnetic material.

For example, the target electronic device 2120 according to the embodiment may include a first magnetic material 2121 located at a first region.

Herein, the target electronic device 2120 according to the embodiment may be designed by a manufacturer, provider of the target electronic device, etc., and at least one region thereof may include at least one magnetic material.

In addition, referring back to FIG. 12, at least one region of the first body 2110 included in the cover device according to the embodiment may include at least one magnetic material.

For example, the first body 2110 included in the cover device according to the embodiment may include a second magnetic material 2111 located at a second region and a third magnetic material 2122 located at a third region, but is not limited thereto.

In addition, according to the embodiment, a location of a magnetic material included in the first body 2110 included in the cover device may be designed based on a location of a magnetic material included in the target electronic device 2120.

For example, according to the embodiment, the second magnetic material 2111 included in the first body 2110 included in the cover device may be designed to be located in the second region corresponding to the first region where the first magnetic material 2121 included in the target electronic device 2120 is located, but is not limited thereto.

In addition, according to the embodiment, a location of a magnetic material included in the first body 2110 included in the cover device may be designed to maintain a balance of a magnetic force between the magnetic material included in the first body 2110 and the magnetic material included in the target electronic device 2120 when the target electronic device 2120 is located in parallel to the first body 2110.

For example, according to the embodiment, the second magnetic material 2111 included in the first body 2110 included in the cover device may be designed to be located in the second region corresponding to the first region in which the first magnetic material 2121 included in the target electronic device 2120 is located so as to maintain a balance of a magnetic force between the first body 2110 and the first magnetic material 2121 included in the target electronic device 2120 when the target electronic device 2120 is located in parallel to the first body 2110, but is not limited thereto.

In addition, according to the embodiment, a location of a magnetic material included in the first body 2110 included in the cover device may be designed to maintain a balance of a magnetic force between the magnetic material included in the first body 2110 and the magnetic material included in the target electronic device 2120 when the target electronic device 2120 is located to be perpendicular to the first body 2110.

For example, according to the embodiment, the third magnetic material 2112 included in the first body 2110 included in the cover device may be designed to be located in the third region corresponding to the first region in which the first magnetic material 2121 included in the target electronic device 2120 is located so as to maintain a balance of a magnetic force between the first body 2110 and the first magnetic material 2121 included in the target electronic device 2120 when the target electronic device 2120 is located to be perpendicular to the first body 2110, but is not limited thereto.

In addition, according to the embodiment, the second magnetic material 2111 and the third magnetic material 2112 included in the first body 2110 included in the cover device may be arrayed in different directions.

For example, according to the embodiment, the array directions of the second magnetic material 2111 and the third magnetic material 2112 included in the first body 2110 included in the cover device may be perpendicular to each other, but are not limited thereto.

In addition, according to the embodiment, a distance between the center of the second magnetic material 2111 included in the first body 2110 included in the cover device and a vertical center line of the first body 2110 may be equal to a distance between the center of the third magnetic material 2112 and a horizontal center line of the first body 2110, but is not limited thereto.

In addition, according to the embodiment, the shape of the second magnetic material 2111 and the shape of the third magnetic material 2112 included in the first body 2110 included in the cover device may be equal to each other.

For example, according to the embodiment, the second magnetic material 2111 and the third magnetic material 2112 included in the first body 2110 included in the cover device may have equal shapes and different array directions, but are not limited thereto.

In addition, as described above from FIG. 12, when the arrangement of the magnetic materials included in the first body 2110 included in the cover device according to the embodiment is designed, the target electronic device 2120 may be placed horizontally or vertically according to an intention of the user, so the user convenience can be enhanced.

Methods according to the embodiments may be embodied as program instructions executable by various computer means and may be recorded on a computer-readable recording medium. The computer-readable recording medium may include program instructions, data files, data structures, and the like separately or in combinations. The program instructions to be recorded on the computer-readable recording medium may be specially designed and configured for the embodiments may be well-known to and be usable by those skilled in the art of computer software. Examples of the computer-readable recording medium include magnetic recording media such as hard disks, floppy disks and magnetic tapes; optical data storage media such as CD-ROMs or DVD-ROMs; magneto-optical media such as floptical disks; and hardware devices, such as read-only memory (ROM), random-access memory (RAM), and flash memory, which are particularly structured to store and implement the program instructions. Examples of the program instructions include not only a mechanical language code formatted by a compiler but also a high level language code that may be implemented by a computer using an interpreter, and the like. The hardware devices may be configured to be operated by one or more software modules or vice versa to conduct the operation according to the embodiments.

Although the embodiments have been described with reference to the limited embodiments and drawings, it will be understood by those skilled in the art that various modifications and variations may be made from the description. For example, suitable results may be achieved if the described techniques are performed in an order different from the described method, and/or the elements of the above-described system, structure, device, and circuit are coupled or combined in a form different from the described method, or replaced or substituted by other elements or equivalents.

Therefore, other implementations, other embodiments, and equivalents to the claims are also within the scope of the following claims.

MODE FOR INVENTION

As described above, the relevant subjects have been described in the best mode for embodying the present disclosure.

The invention claimed is:

1. A cover device comprising:

a first body; and a second body comprising a first plate, a second plate and a third plate, wherein the first plate is rotatably connected to the first body, wherein second plate is rotatably connected to the first plate, wherein the third plate is rotatably connected to the second plate;

wherein a first region of the first body comprises a first magnetic material, a second region of the first body comprises a second magnetic material, and a third region of the third plate comprises a third magnetic material, allowing the third region of the third plate to attach to either the first region or the second region of the first body, wherein, when the third region of the third plate is attached to an outer surface of either the first region or the second region of the first body, the first plate, the second plate and the first body form and maintain a first triangular pillar, wherein, when the third region of the third plate is attached to the outer surface of either the first region or the second region of the first body, at least a part of the first plate constitutes at least a part of a first side wall of the first triangular pillar, at least a part of the second plate constitutes at least a part of a second side wall of the first triangular pillar and at least a part of the first body constitutes at least a part of a third side wall of the first triangular pillar, wherein, as the third region of the third plate moves from being attached to the outer surface of the first region of the first body to being attached to the outer surface of the second region of the first body, an angle between the first side wall and the third side wall of the first triangular pillar changes, thereby changing the angle between the first plate and the first body.

2. The cover device of claim 1, wherein a shape of the first triangular pillar varies depending on a position of the third plate.

3. The cover device of claim 2, wherein if the second region of the first body is farther from a first end of the first body than the first region of the first body, a first angle which is an angle between the first plate and the first body when the third region of the third plate is attached to the outer surface of the second region of the first body is smaller than a second angle which is an angle between the first plate and the first body when the third region of the third plate is attached to the outer surface of the first region of the first body.

4. The cover device of claim 3, wherein the first angle and the third angle are within a range of 45 to 90 degrees.

5. The cover device of claim 1, wherein the first magnetic material and the second magnetic material are provided in the form of a single plate.

6. The cover device of claim 5, wherein the first body is formed such that a length in a longitudinal direction is longer than a length in a width direction, wherein a shape of the single plate extends at least in the width direction of the first body.

7. The cover device of claim 1, wherein when a width of the first plate is a first length, a width of the second plate is a second length and a width of a first connection portion connecting the first body and the first plate is a third length, the first to third length are designed to satisfy the following relational equation, (the first length+the third length)*0.8≤the second length≤(the first length+the third length)*1.2 [relational equation]

8. The cover device of claim 1, wherein no magnetic material is located between the first region and the second region.

9. The cover device of claim 1, wherein the first plate, the second plate, the third plate and the first body are configured to allow to form and maintain a second triangular pillar, wherein, when the first plate, the second plate, the third plate, and the first body constitute the second triangular pillar, at least a part of the first plate and at least a part of the second plate constitute at least a part of a fourth side wall of the second triangular pillar, at least a part of the third plate constitutes at least a part of a fifth side wall of the second triangular pillar and at least a part of the first body constitutes at least a part of a sixth side wall of the second triangular pillar.

10. The cover device of claim 9, wherein the cover device is further comprising:

an auxiliary plate rotatably connected to the third plate;

wherein the auxiliary plate comprises a fourth magnetic material, allowing the auxiliary plate to attach to the first body, wherein as the auxiliary plate attaches to an outer surface of the first body, the first plate, the second plate, the third plate and the first body form and maintain the second triangular pillar.

11. The cover device of claim 1, wherein, when the third region of the third plate is attached to the outer surface of either the first region or the second region of the first body, an outer surface of the third region of the third plate is attached to the outer surface of either the first region or the second region of the first body.

* * * * *